US008001671B2

(12) United States Patent
Mitchell

(10) Patent No.: US 8,001,671 B2
(45) Date of Patent: Aug. 23, 2011

(54) METHOD FOR SECURING A BEVERAGE CONTAINER TO A MOUNTING SURFACE

(76) Inventor: Jed D. Mitchell, Lakewood, CO (US)

( * ) Notice: Subject to any disclaimer, the term of this patent is extended or adjusted under 35 U.S.C. 154(b) by 0 days.

(21) Appl. No.: 12/720,320

(22) Filed: Mar. 9, 2010

(65) Prior Publication Data

US 2010/0187387 A1 Jul. 29, 2010

Related U.S. Application Data

(60) Division of application No. 11/672,855, filed on Feb. 8, 2007, which is a continuation-in-part of application No. 10/382,459, filed on Mar. 5, 2003, now abandoned.

(60) Provisional application No. 60/866,326, filed on Nov. 17, 2006.

(51) Int. Cl.
*B23P 11/00* (2006.01)
*A47G 1/17* (2006.01)

(52) U.S. Cl. ..... 29/525.01; 29/469; 29/464; 248/309.4; 248/311.2; 220/737

(58) Field of Classification Search ..... 248/311.2, 248/314, 309.1, 206.5, 309.4; 428/34.1, 428/102, 104; 220/737; 224/275; 29/525.01, 29/464, 469, 450
See application file for complete search history.

(56) References Cited

U.S. PATENT DOCUMENTS 2,580,099 A * 12/1951 Jaeger ..... 335/285
3,028,631 A 4/1962 Cook
3,285,456 A 11/1966 Pewitt
3,524,614 A 8/1970 Sorth
3,556,341 A 1/1971 Rains
4,447,238 A * 5/1984 Eldridge, Jr. ..... 24/303
4,700,436 A 10/1987 Morita
4,779,314 A * 10/1988 Aoki ..... 24/303
5,186,350 A 2/1993 McBride
5,409,190 A 4/1995 Mattox
5,456,436 A 10/1995 Faudie
5,490,607 A 2/1996 Hsieh et al.
5,500,121 A * 3/1996 Thornton et al. ..... 210/222
5,655,742 A 8/1997 Whitman et al.
5,704,579 A 1/1998 Celentino et al.
5,709,105 A 1/1998 Palermo
5,816,548 A 10/1998 Blossom, III
5,873,486 A * 2/1999 Morgan ..... 220/739
5,992,807 A 11/1999 Tarulli
5,996,821 A 12/1999 Farber et al.

(Continued)

OTHER PUBLICATIONS

Official Action for U.S. Appl. No. 11/672,855, mailed Dec. 8, 2010.
Notice of Allowance for U.S. Appl. No. 11/672,859, mailed Oct. 27, 2010.
U.S. Appl. No. 12/248,542, filed Oct. 9, 2008, Mitchell.
U.S. Appl. No. 12/699,614, filed Feb. 3, 2010, Mitchell.

(Continued)

*Primary Examiner* — Essama Omgba
(74) *Attorney, Agent, or Firm* — Sheridan Ross P.C.

(57) ABSTRACT

A method for using an insulated holder is provided. The holder includes first and second polarized magnetic materials positioned at the sleeve portion. The first and second polarized magnetic materials each have first and second poles, the first pole of the first polarized magnetic material being positioned opposite and adjacent to the second pole of the second magnetic material and the second pole of the first polarized magnetic material being positioned opposite and adjacent to the first pole of the second magnetic material. The holder is placed adjacent to and in contact with said mounting surface.

12 Claims, 31 Drawing Sheets

U.S. PATENT DOCUMENTS

| | | | | |
|---|---|---|---|---|
| 6,065,632 | A * | 5/2000 | Moore, Jr. | 220/483 |
| 6,145,715 | A | 11/2000 | Slonim | |
| 6,193,202 | B1 * | 2/2001 | Rogers | 248/311.2 |
| 6,286,798 | B1 * | 9/2001 | Chun | 248/311.2 |
| 6,305,656 | B1 * | 10/2001 | Wemyss | 248/309.4 |
| 6,390,319 | B1 * | 5/2002 | Yu | 220/230 |
| 6,491,271 | B1 | 12/2002 | Adams | |
| 6,576,128 | B1 | 6/2003 | Jackson | |
| 6,643,845 | B2 | 11/2003 | O'Dea et al. | |
| 6,786,349 | B2 | 9/2004 | Najd | |
| 7,021,594 | B2 * | 4/2006 | Exler | 248/311.2 |
| 7,328,648 | B2 * | 2/2008 | Lutzker | 99/277.1 |
| 7,677,407 | B2 * | 3/2010 | Davis | 220/739 |
| 2003/0047578 | A1 | 3/2003 | Barnett | |
| 2003/0197042 | A1 | 10/2003 | Warren | |
| 2004/0020959 | A1 * | 2/2004 | Sellars | 224/675 |
| 2004/0021049 | A1 | 2/2004 | Payne et al. | |
| 2004/0084593 | A1 | 5/2004 | Barfield | |
| 2004/0104320 | A1 | 6/2004 | Exler | |
| 2004/0173719 | A1 * | 9/2004 | Mitchell | 248/311.2 |
| 2005/0006547 | A1 * | 1/2005 | Exler | 248/311.2 |
| 2005/0056646 | A1 * | 3/2005 | Gary | 220/483 |
| 2005/0056655 | A1 * | 3/2005 | Gary | 220/737 |
| 2006/0021989 | A1 * | 2/2006 | Friedman | 220/703 |
| 2006/0021990 | A1 * | 2/2006 | Friedman | 220/703 |
| 2006/0201956 | A1 * | 9/2006 | Romo | 220/737 |
| 2007/0017924 | A1 * | 1/2007 | Hundley | 220/737 |
| 2007/0068948 | A1 * | 3/2007 | Friedman | 220/501 |
| 2007/0114351 | A1 * | 5/2007 | Mitchell | 248/311.2 |
| 2007/0176069 | A1 * | 8/2007 | Mitchell | 248/311.2 |
| 2007/0176070 | A1 * | 8/2007 | Mitchell | 248/311.2 |
| 2008/0060479 | A1 * | 3/2008 | Nelson | 81/3.09 |
| 2008/0110882 | A1 | 5/2008 | Jang | |
| 2009/0127417 | A1 * | 5/2009 | Mitchell | 248/309.4 |
| 2010/0032461 | A1 * | 2/2010 | Kriner | 224/163 |

OTHER PUBLICATIONS

Magna-Mug.com Website at http://www.magna-mug.com (Oct. 2003), 8 pages.
Magna Can Website at http://www.magnacan.com (printed Aug. 19, 2004), 2 pages.
Declaration of Jed Mitchell Under 37 CFR Section 1.132, including Exhibits A-C.
Official Action for Canadian Patent Application No. 2,459,662, dated Mar. 5, 2010.
Official Action for U.S. Appl. No. 11/655,502, mailed Apr. 3, 2009.
Restriction Requirement for U.S. Appl. No. 11/672,855, mailed Oct. 1, 2009.
Restriction Requirement for U.S. Appl. No. 12/358,713, mailed Oct. 1, 2009.
Restriction Requirement for U.S. Appl. No. 11/672,859, mailed Dec. 17, 2009.
Official Action for U.S. Appl. No. 11/655,502, mailed Dec. 24, 2009.
Official Action for U.S. Appl. No. 11/672,859, mailed Mar. 8, 2010.
Official Action for U.S. Appl. No. 12/358,713, mailed Mar. 19, 2010.
Official Action for U.S. Appl. No. 10/382,459, mailed Jul. 16, 2003.
Official Action for U.S. Appl. No. 10/382,459, mailed Jan. 22, 2004.
Official Action for U.S. Appl. No. 10/382,459, mailed Jun. 16, 2004.
Official Action for U.S. Appl. No. 10/382,459, mailed Mar. 24, 2005.
Official Action for U.S. Appl. No. 10/382,459, mailed Sep. 22, 2005.
Restriction Requirement for U.S. Appl. No. 10/382,459, mailed May 11, 2006.
Official Action for U.S. Appl. No. 10/382,459, mailed Sep. 11, 2006.
Restriction Requirement for U.S. Appl. No. 11/655,502, mailed Jul. 17, 2008.
Official Action for Canadian Patent Application No. 2,459,662, dated Feb. 8, 2011.

* cited by examiner

METHOD FOR SECURING A BEVERAGE CONTAINER TO A MOUNTING SURFACE

CROSS REFERENCE TO RELATED APPLICATION

The present application is a divisional of U.S. patent application Ser. No. 11/672,855, filed Feb. 8, 2007, which is a continuation-in-part under 35 U.S.C. §120 of U.S. patent application Ser. No. 10/382,459, filed Mar. 5, 2003, entitled "Magnetized Beverage Container Holder" (now abandoned), and claims priority under 35 U.S.C. §119(e) from U.S. Provisional Application Ser. No. 60/866,326, filed Nov. 17, 2006, of the same title, which are all incorporated herein by this reference.

FIELD OF THE INVENTION

The present invention relates generally to holders for beverage containers, and more specifically, to a magnetized beverage container holder used to secure a beverage container to a surface.

BACKGROUND OF THE INVENTION

In numerous situations, for several reasons, people drink beverages from beverage containers, such as boating, tailgating, working, etc. For example, while boating a person may be exposed to heat and sun for several hours, and remaining hydrated is important. In many of these situations, finding a place to store the beverage container in which the container will not be inadvertently spilled or knocked over can be problematic. On a boat, for example, simply placing a beverage container on a flat surface is often unsatisfactory since the container may tip over as a result from typical movement of the boat rocking on the water. Likewise, when operating heavy machinery during construction or farming operations one might find it difficult or even impossible to retain a beverage without spilling. Similarly, at picnics or other outdoor gatherings, placing a beverage container on the ground may result in spilling as a result of a person or animal inadvertently kicking the container.

Numerous container holders exist which attempt to solve the above-mentioned problems. For example, holders exist for the attachment to platforms, such as boats, in which a beverage container may be placed. Such holders are typically secured to the platform by screws, for example. While such a holder provides a place for container storage, it also has disadvantages. For example, the holder is permanently secured in one place on the platform, thus providing limited flexibility for storing such beverage containers. While additional holders may be installed in areas which are most convenient for such storage, the additional holders may cause clutter in those areas. Furthermore, if a person wishes to be in an area which does not have a holder installed, that person must either hold the container, or store the container in area which does have a holder, which may be inconvenient for the person due to having to move to the other area every time they wish to drink from the container. Accordingly, it would be beneficial to have a holder for a beverage container which is able to be moved from place to place with relative ease, and which helps to prevent inadvertent spilling of the beverage container.

SUMMARY OF THE INVENTION

These and other needs are addressed by the various embodiments and configurations of the present invention.

The invention provides a method and apparatus for mounting a beverage container holder to a mounting surface. The beverage container holder includes a magnet and may be mounted to any mounting surface which contains a ferrous material in sufficient quantity to produce sufficient attraction to the magnet to secure and hold the beverage container holder, and beverage container, to the mounting surface.

In one aspect, the present invention provides a beverage container holder, including a holder which is adapted to receive a beverage container and a magnet operatively associated with the holder and operable to interact magnetically with a mounting surface. The magnet is operable to secure the holder to the mounting surface such that the side of the beverage container is at least substantially parallel to, and preferably, along substantially the entire height of the side, in contact with the mounting surface. The mounting surface may be substantially vertical, thus holding the beverage container holder and beverage container in a substantially upright position. In one embodiment, the holder includes a pouch on the holder adapted to receive the magnet and secure the magnet to the holder. In another embodiment, the magnet is secured to the holder using adhesive. In another embodiment, the magnet is embedded within the holder, and the holder includes a visual indicator and/or surface texturing indicating the location of the magnet within the holder. The magnet preferably has a total force of at least about 800 and more preferably about 800-12,300 gauss.

The mounting surface includes a ferrous material, and in one embodiment, the mounting surface is a ferrous material. The mounting surface may also include a non-ferrous material with a ferrous material adjacent thereto which interacts with the magnet to secure the holder to the mounting surface. The ferrous material may be secured with a rivet or other mechanical fastening device.

In another aspect, the present invention provides a method for securing a beverage container to a mounting surface. The method includes providing a holder adapted to receive the beverage container, the holder being operatively engaged with a magnet, and placing the holder adjacent to the mounting surface. The magnet is operable to interact with the mounting surface and secure the holder and beverage container to the mounting surface, with a side of the beverage container being at least substantially parallel to the mounting surface.

Another aspect of the present invention provides a method of manufacturing a holder for a beverage container. The method of manufacturing includes forming a sleeve portion of the holder, with the sleeve portion being adapted to receive the beverage container. A magnet is secured to the sleeve portion in a position such that the side of the beverage container is substantially parallel to a mounting surface when the beverage container is located in the sleeve and the holder is engaged with the mounting surface. A base portion may be formed and secured to a first end of the sleeve, substantially closing the first end of the sleeve. The sleeve portion may be formed by injection molding an insulation material into a sleeve form. The sleeve portion may also be formed by stitching end portions of a rectangular fabric together to form the sleeve portion. A pouch may also be stitched to the sleeve, the pouch being adapted to receive the magnet, and the magnet inserted into the pouch. The magnet may also be secured to the sleeve with an adhesive, where the adhesive is applied to at least one of the magnet and the sleeve portion, the magnet is positioned against the sleeve portion, and the adhesive is cured to secure the magnet to the sleeve portion. The magnet may also be secured to the sleeve by inserting the magnet into a preformed aperture in the sleeve.

In yet another aspect, the holder is manufactured entirely using injection molding, particularly Reaction Injection Molded ("RIM") techniques. The magnet is mounted on an interior paramagnetic, superparamagnetic, metamagnetic, ferrimagnetic, or ferromagnetic (e.g., ferrous-containing) surface of the mold. The mounting surface is typically in the shape of a pin or protrusion. In the mounted position, the magnet is spaced from a surrounding interior mold surface. With the exception of the protrusion, the mold is preferably otherwise not paramagnetic, superparamagnetic, metamagnetic, ferrimagnetic, or ferromagnetic, or magnetically attractive, and even more preferably is diamagnetic or superdiamagnetic. In this manner, the magnet is retained in a desired orientation relative to the mold surfaces during resin injection. As will be appreciated, the magnet may be retained in a desired position and orientation in the mold during resin introduction using, instead of magnetic attraction, a friction fit between the protrusion and magnet. The mold may be an open or closed mold. Resin is then introduced into the mold while the magnet is magnetically engaged with the protrusion. After the resin has cured and cooled, the holder, which contains the magnet embedded in the sidewall of the holder, is removed from the mold. The removal force applied to the holder is, of course, greater than the magnetic force of attraction between the magnet and the protrusion.

In another aspect, the present invention provides a beverage container holder including holding means for holding a beverage container, and mounting means for mounting the holding means to a mounting surface. The mounting means is secured to the holding means such that, when the beverage container is located in the holding means and the holding means is mounted to the mounting surface, a side of the beverage container is at least substantially parallel to the mounting surface. The mounting means may include a magnet which is secured to the holding means.

Yet another aspect of the present invention provides a system for holding a beverage container. The system includes a beverage container, a holder adapted to receive the beverage container, a magnet operatively engaged with the holder, and a mounting surface operative to engage with the magnet and secure the holder to the mounting surface. When the holder is secured to the mounting surface, a side of the beverage container is substantially parallel to the mounting surface. The mounting surface may be substantially vertical.

In yet another embodiment, the exterior surface of the holder adjacent to the magnet is flat or substantially planar and is coplanar with at least a portion of the outer cylindrical surface of the holder. This provides an expanded area of contact with the mounting surface in the area of the magnet and additional contact area along a height of the outer cylindrical sidewall of the holder. The outer surface of the holder may be textured, roughened, to provide increased frictional force along the contact area between the holder and the mounting surface. In one configuration, the texturing is effected by sandblasting the inner surface of the mold at least in the area adjacent to the holder contact area. The mold surface will be pockmarked, thereby imparting a roughened surface to the holder.

In yet another embodiment, a magnet assembly includes first and/or second polarized materials and a paramagnetic, superparamagnetic, metamagnetic, ferromagnetic, antiferromagnetic, and/or ferrimagnetic backing plate. The backing plate preferably contacts the magnetic material and is adjacent to, or faces, the interior of the holder to decrease the magnetic force of attraction to the beverage container.

These and other advantages will be apparent from the disclosure of the invention(s) contained herein.

The above-described embodiments and configurations are neither complete nor exhaustive. As will be appreciated, other embodiments of the invention are possible utilizing, alone or in combination, one or more of the features set forth above or described in detail below.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

It is to be noted that the term "a" or "an" entity refers to one or more of that entity. As such, the terms "a" (or "an"), "one or more" and "at least one" can be used interchangeably herein. It is also to be rioted that the terms "comprising", "including", and "having" can be used interchangeably.

DETAILED DESCRIPTION

Figure 1:
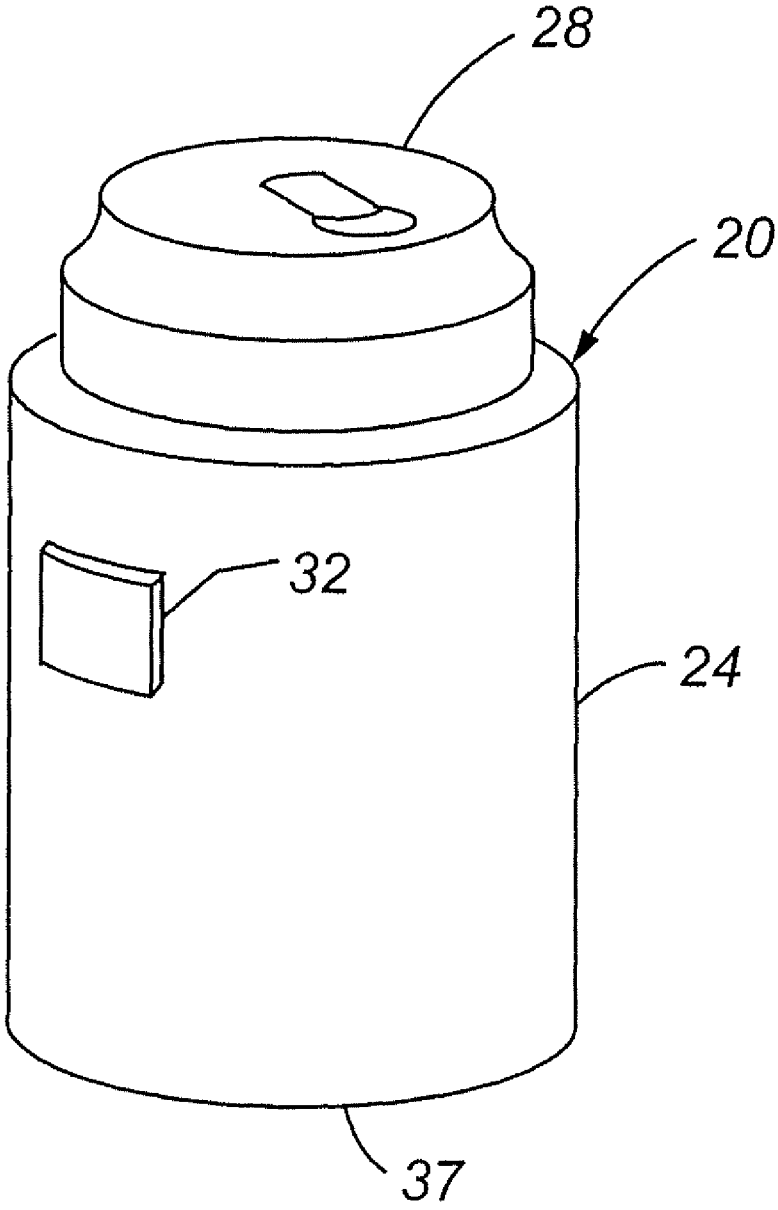
FIG. 1 is a perspective illustration of a beverage container holder for one embodiment of the present invention.

Referring to FIG. 1, an illustration of a beverage container holder 20 of one embodiment of the present invention is described. The beverage container holder 20 includes a sleeve 24 into which a beverage container 28 may be placed. The beverage container holder 20 also includes a magnet 32 which is secured to the sleeve 24. The beverage container holder 20 may also include a base 37 which helps to prevent the beverage container 28 from sliding completely through the sleeve 24 and can provide additional insulation. The magnet 32 serves to mount container holder 20 to any mounting surface. As used herein, mounting surface refers to any surface to which the beverage container holder 20 may be mounted. Mounting surfaces include paramagnetic, superparamagnetic, metamagnetic, ferromagnetic, ferrimagnetic and antiferromagnetic materials (e.g., ferrous materials), and diamagnetic or superdiamagnetic materials (e.g., non-ferrous materials), which have a paramagnetic, superparamagnetic, metamagnetic, ferromagnetic, ferrimagnetic, and/or antiferromagnetic surface associated with them such that the magnet 32 has a sufficient magnetic attraction to hold the beverage container holder 20 to the mounting surface. A mounting surface may also have a second magnet associated therewith, which provides additional magnetic force to hold the beverage container holder 20 more securely to the mounting surface. In this manner, the beverage container holder 20 may be mounted in positions which are not necessarily predetermined.

Figure 5:
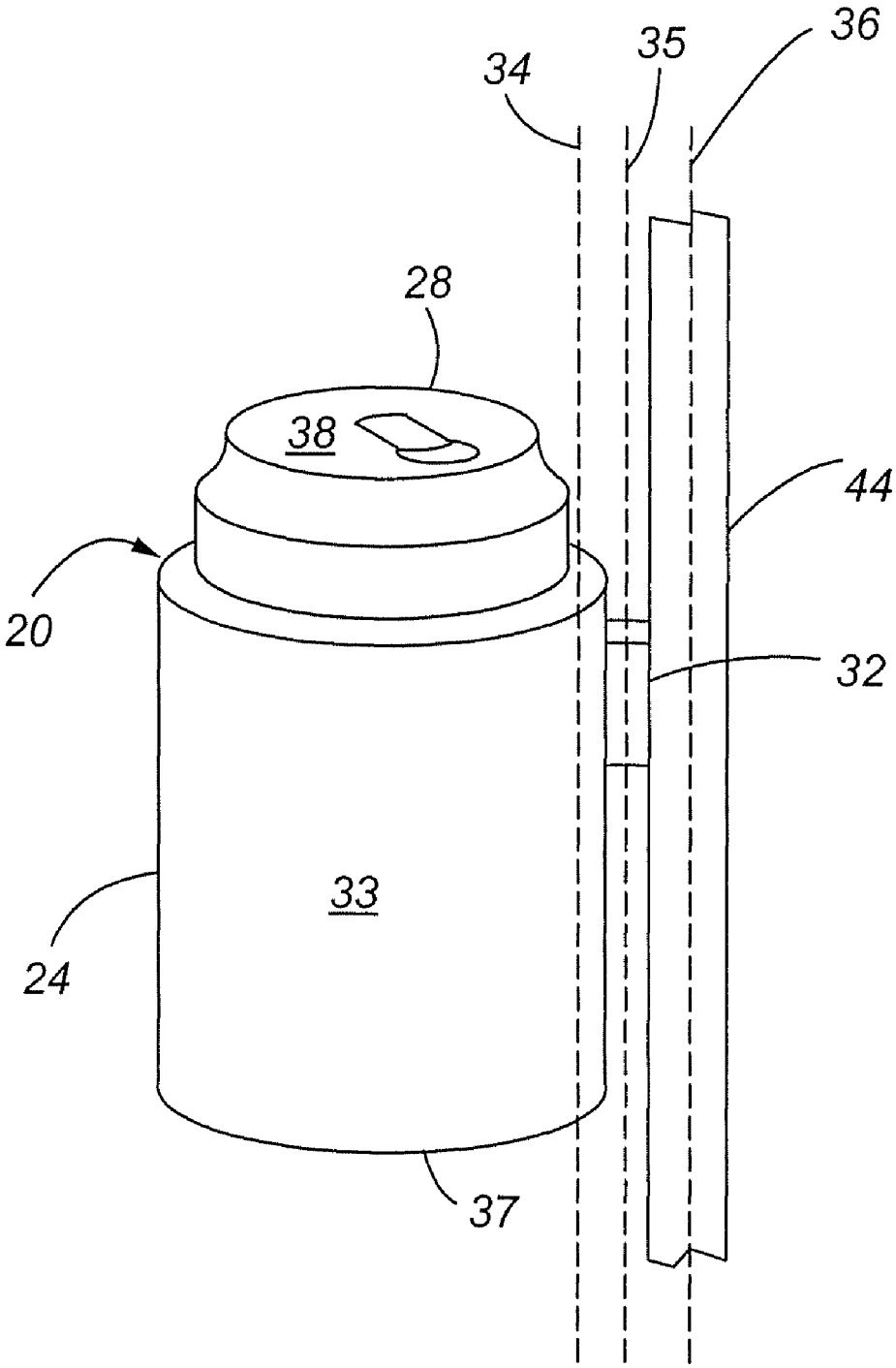
FIG. 5 is a perspective illustration of a beverage container holder mounted to a mounting surface for one embodiment of the present invention.

The orientation of the various components is shown in FIG. 5. As illustrated in FIG. 5, a plane 34 associated with the cylindrical side of the beverage container 28 is at least substantially parallel to a plane 35 associated with the longitudinal center line 35 of the magnet 32, and also at least substantially parallel to a plane 36 associated with a planar mounting surface 44. The base 37 of the holder 20 (and the top 38 and base (not shown) of the beverage container 28) is at least substantially normal to the plane 36 of the mounting surface 44.

Figure 2:
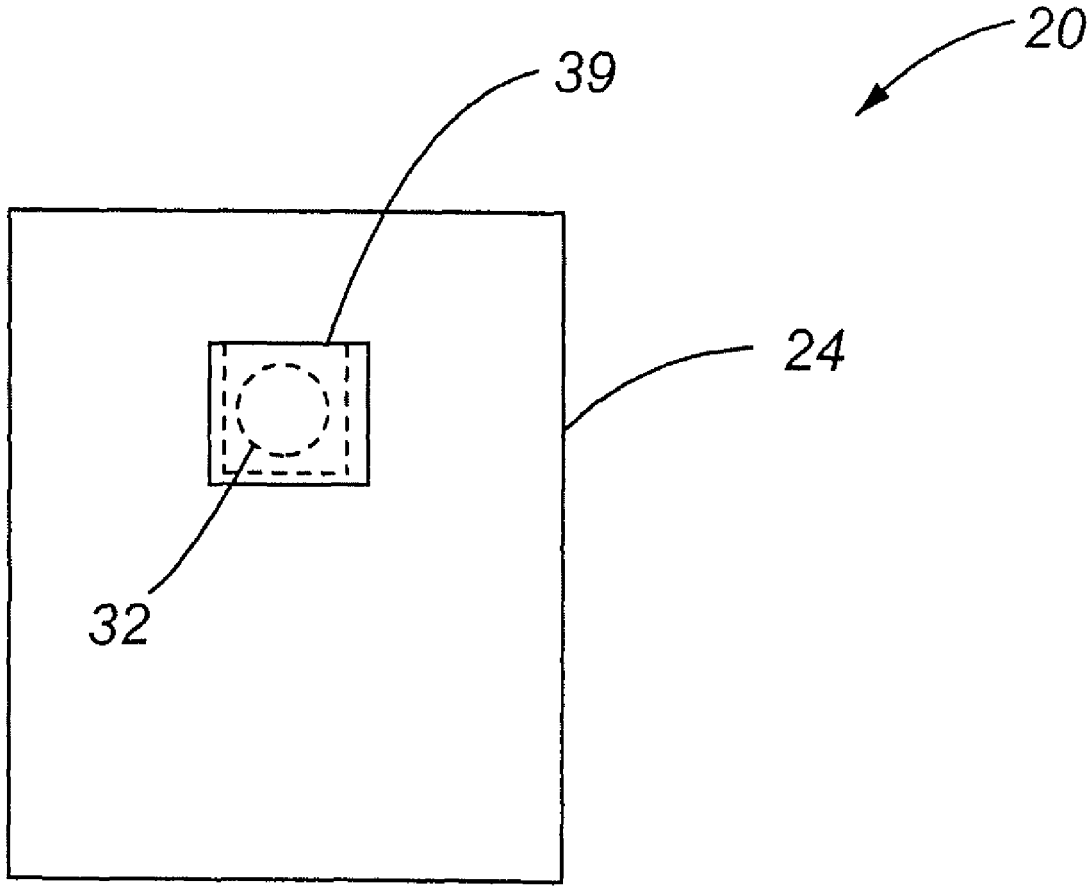
FIG. 2 is an illustration of a pouch adapted to receive a magnet for one embodiment of the present invention.

In the embodiment of FIG. 1, the magnet 32 is affixed to the outer surface of the sleeve 24. The magnet 32 may be affixed in any of a number of ways. For example, in one embodiment, illustrated in FIG. 2 the sleeve 24 comprises flexible fabric or foamed resin, and includes a pouch 39. The pouch 39 is also formed of flexible fabric, and is secured to the sleeve 24 by stitching on at least two sides, and up to four sides. The magnet 32, illustrated by dashed lines, is placed within the pouch 39. In this embodiment, the pouch 39 is sized appropriately such that the magnet 32 is secure within the pouch 39, with relatively little movement possible, thus providing a relatively secure mount of the beverage container holder 20 to the mounting surface.

Figure 3:
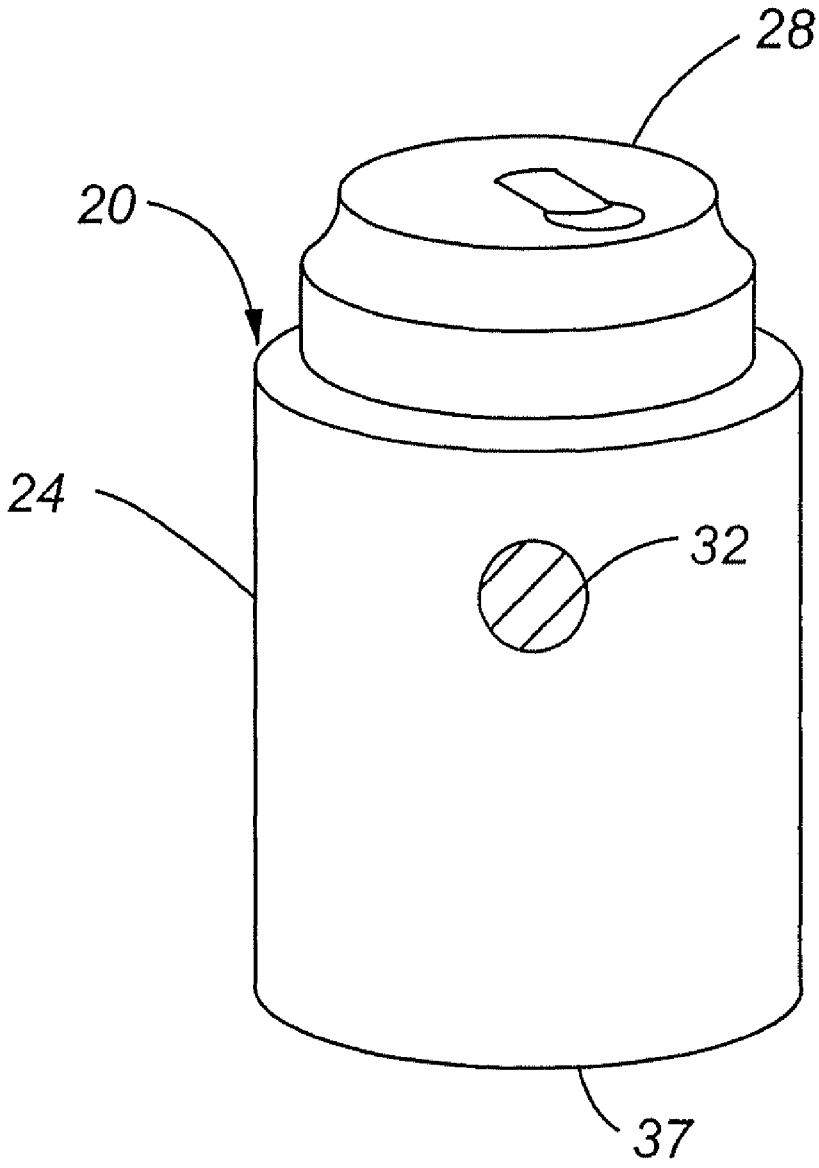
FIG. 3 is a perspective illustration of a beverage container holder for another embodiment of the present invention.
Figure 4:
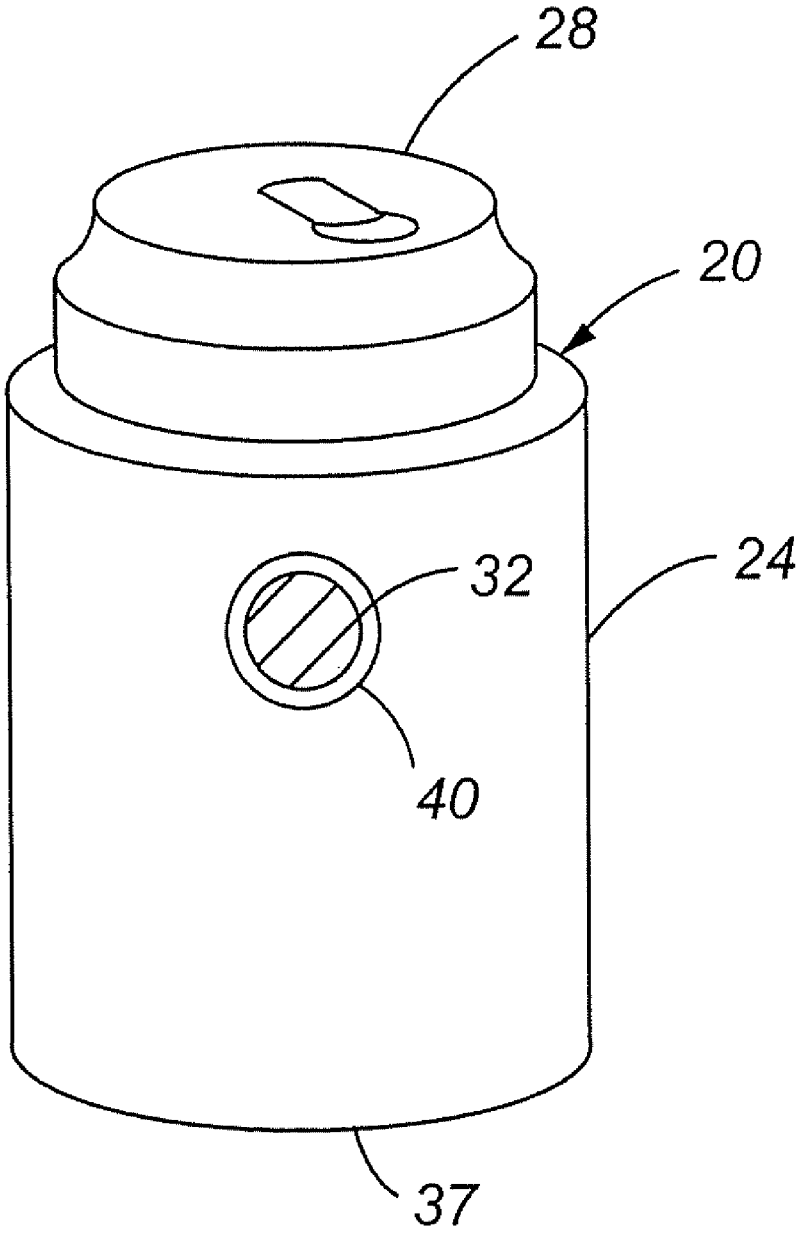
FIG. 4 is a perspective illustration of a beverage container holder for another embodiment of the present invention.
Figure 17:
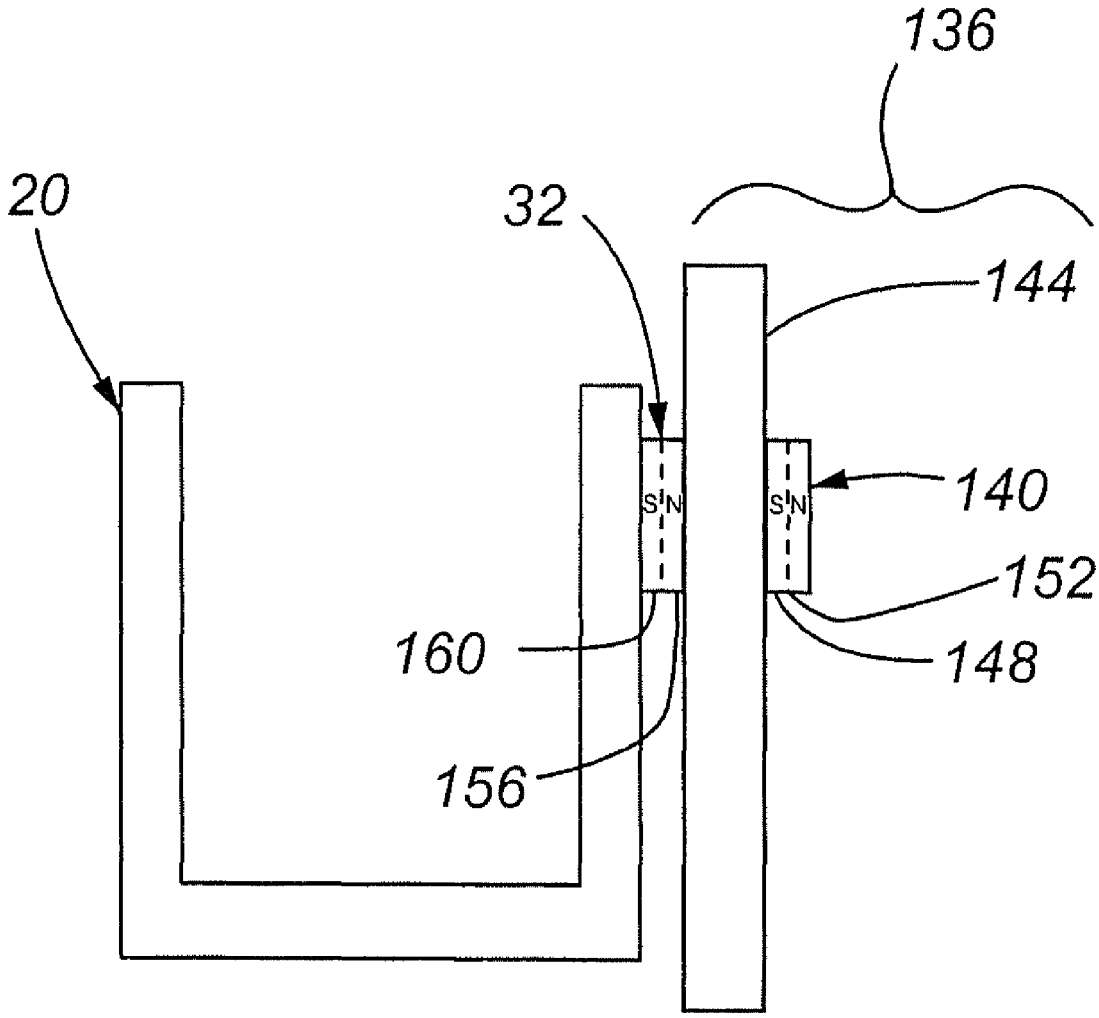
FIG. 17 is a cross-sectional illustration of a beverage container holder mounted to a mounting surface in which the mounting surface and beverage container holder include a disk magnet.

In another embodiment, illustrated in FIG. 3, the magnet 32 is affixed to the sleeve 24 with adhesive (FIG. 17). In this embodiment, the sleeve 24 may be either a flexible material or a rigid material. The magnet 32 may be affixed to the sleeve 24 by applying adhesive to one, or both, of the magnet 32 and sleeve 24, placing the magnet 32 adjacent to the appropriate area on the sleeve 24, and allowing the adhesive to cure. In yet another embodiment, illustrated in FIG. 4, the sleeve 24 is formed of a rigid material having an aperture 40 designed to receive the magnet 32. The magnet 32 may be placed in the aperture 40, and secured with an adhesive. In yet another embodiment, the magnet may be maintained in a desired position and orientation in a mold during resin injection to embed the magnet in the sleeve 24. Alternatively, the aperture 40 may be sized appropriately such that the magnet 32 is held in place by frictional forces. The magnet may also be affixed in other fashions, such as, for example, the magnet 32 may be affixed to the sleeve 24 with a hook and loop material. The magnet may also be affixed by a mechanical fastening device, such as a rivet or screw.

Referring again to FIG. 5, the beverage container holder 20 of the present invention is illustrated as mounted to a vertical mounting surface 44. In this embodiment, the mounting surface 44 is a ferrous material. As will be understood, ferrous material is material which contains iron, such as steel, and is attracted to a magnet. The magnet 32 is of sufficient strength to hold a full beverage container 28, which is placed in the beverage container holder 20, to the mounting surface 44. The magnet 32, in one embodiment, has a total magnetic force of approximately 800-20,000 gauss. In one configuration, the magnet has a strength of about 30 to about 45 MGO. The magnet, in one embodiment, is a rare earth magnet, with a neodymium 35-containing magnet being preferred. A typical formula for such a magnet is $Nd_2Fe_{14}B$. As will be appreciated, when mounting the beverage container holder 20 on the mounting surface 44, it may be mounted in any location on that surface, and hold the beverage container 28 in that position. While the embodiment of FIG. 5 illustrates a relatively large mounting surface to which the beverage container holder 20 mounts, the mounting surface 44 may be only a portion of the surface of a platform.

Figure 6:
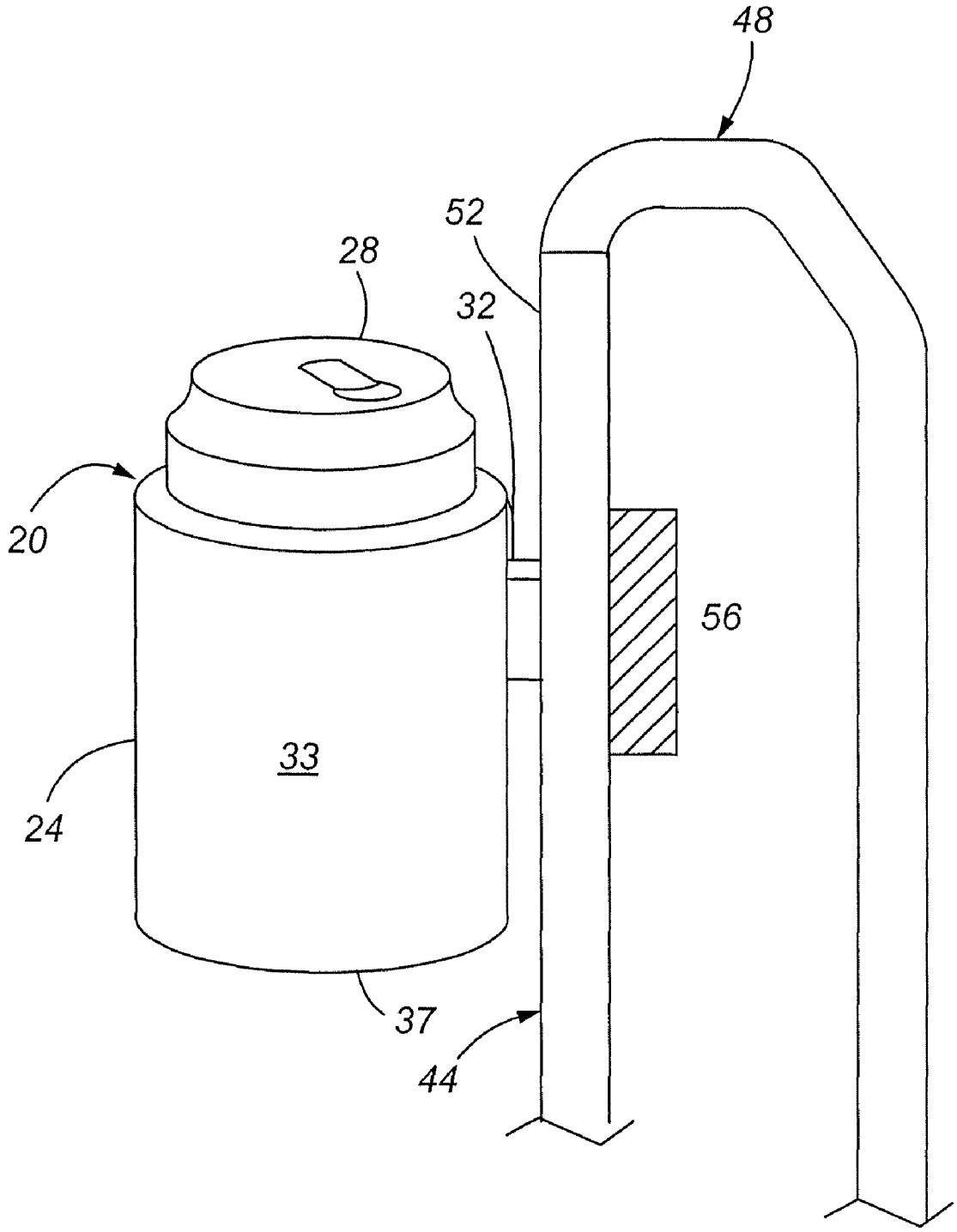
FIG. 6 is a perspective illustration of a beverage container holder mounted to a mounting surface for another embodiment of the present invention.

In one embodiment, as illustrated in FIG. 6, a platform 48 has a non-ferrous material 52 as the outside of the mounting surface 44 to which the beverage container holder 20 may be mounted, and a ferrous material 56 located behind this non-ferrous material 52. The non-ferrous (or diamagnetic or superdiamagnetic) material may be any thickness, provided that the flux between the magnet 32 and the ferrous material 56 is sufficient to securely hold the beverage container 28. As mentioned above, for one embodiment the flux between the magnet 32 and the ferrous material 56 is about 800-12,300 gauss. The platform 48 may be, for example, a boat with the non-ferrous material 52 being fiberglass. Other examples of non-ferrous material include plastic, fabric, and non-ferrous metals. The beverage container holder 20 may be mounted in areas which have the ferrous material 56 located behind the non-ferrous material 52. This configuration may be more aesthetically desirable in some situations where exposed metal is not desired. For example, a boat may have a strip of ferrous material 56 located around its circumference, thus creating a mounting surface 44 which extends along this strip of ferrous material 56 allowing a beverage container holder 20 to be mounted anywhere along this strip around the entire boat.

Figure 7:
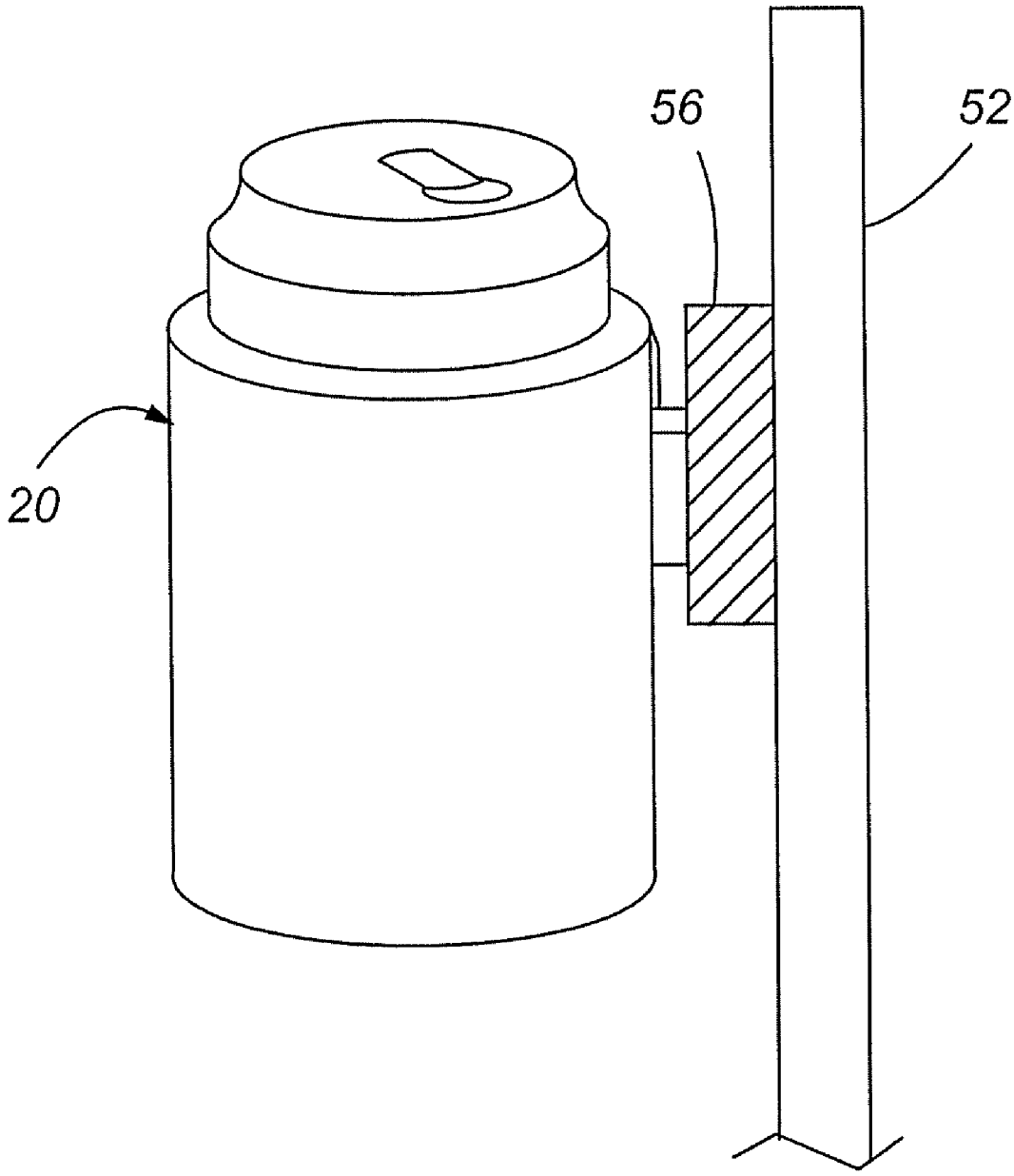
FIG. 7 is a perspective illustration of a beverage container holder mounted to a mounting surface for another embodiment of the present invention.
Figure 8:
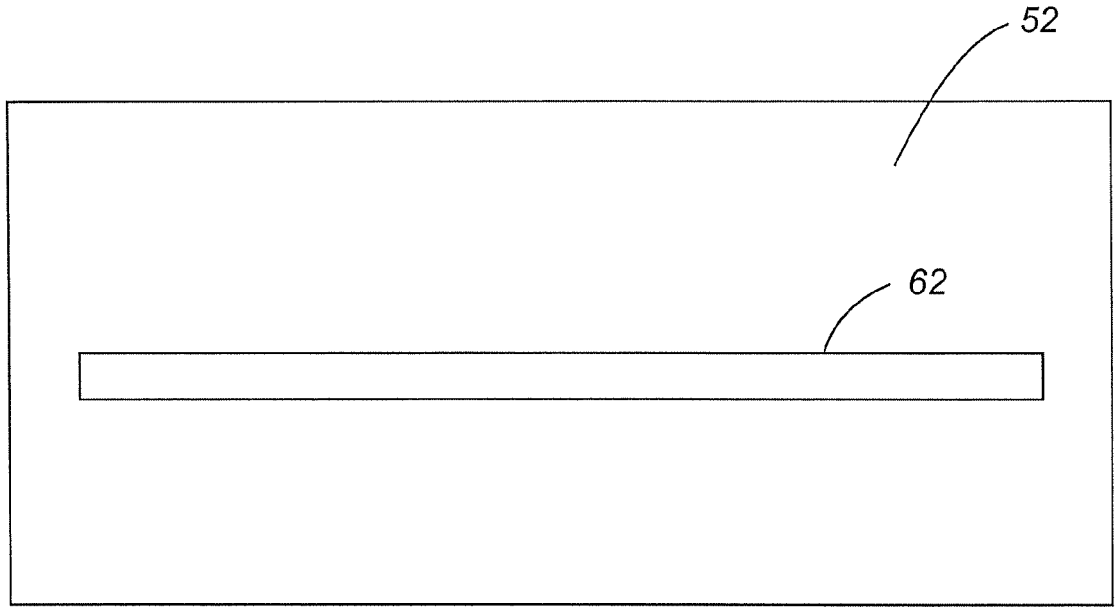
FIG. 8 is a diagrammatic representation of a non-ferrous surface having a strip of ferrous material attached thereto according to one embodiment of the present invention.
Figure 9:
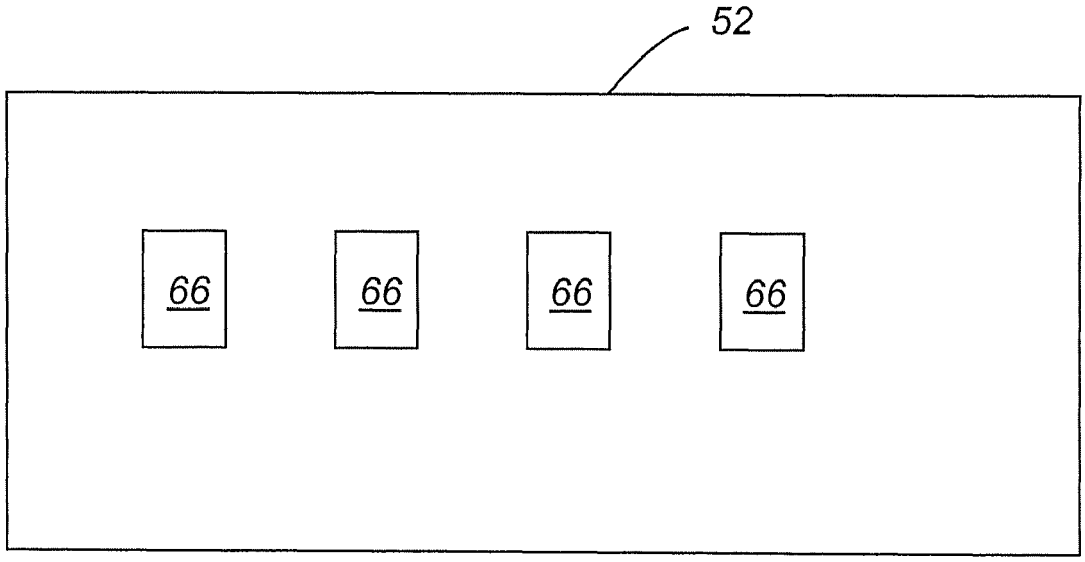
FIG. 9 is a diagrammatic representation of a non-ferrous surface having a number of ferrous plates attached thereto according to an embodiment of the present invention.

In another embodiment, as illustrated in FIG. 7, ferrous material 56 is be located in front of a non-ferrous material 52 to form a mounting surface. In this case, the ferrous material 56 is visible, and the beverage container holder 20 may be mounted thereon. In one embodiment, the ferrous material 56 is covered with a protective coating in order to help prevent corrosion from, for example, salt water. The ferrous material 62 may be in the form of a strip of material, as illustrated in FIG. 8. Alternatively, as illustrated in FIG. 9, the ferrous material may be in the form of decorative plates 66 which are mounted periodically on the external surface of the non-ferrous material 52. Thus, a beverage container holder 20 could be mounted directly on the strip of ferrous material 62, or on any of these decorative plates 66.

Figure 10:
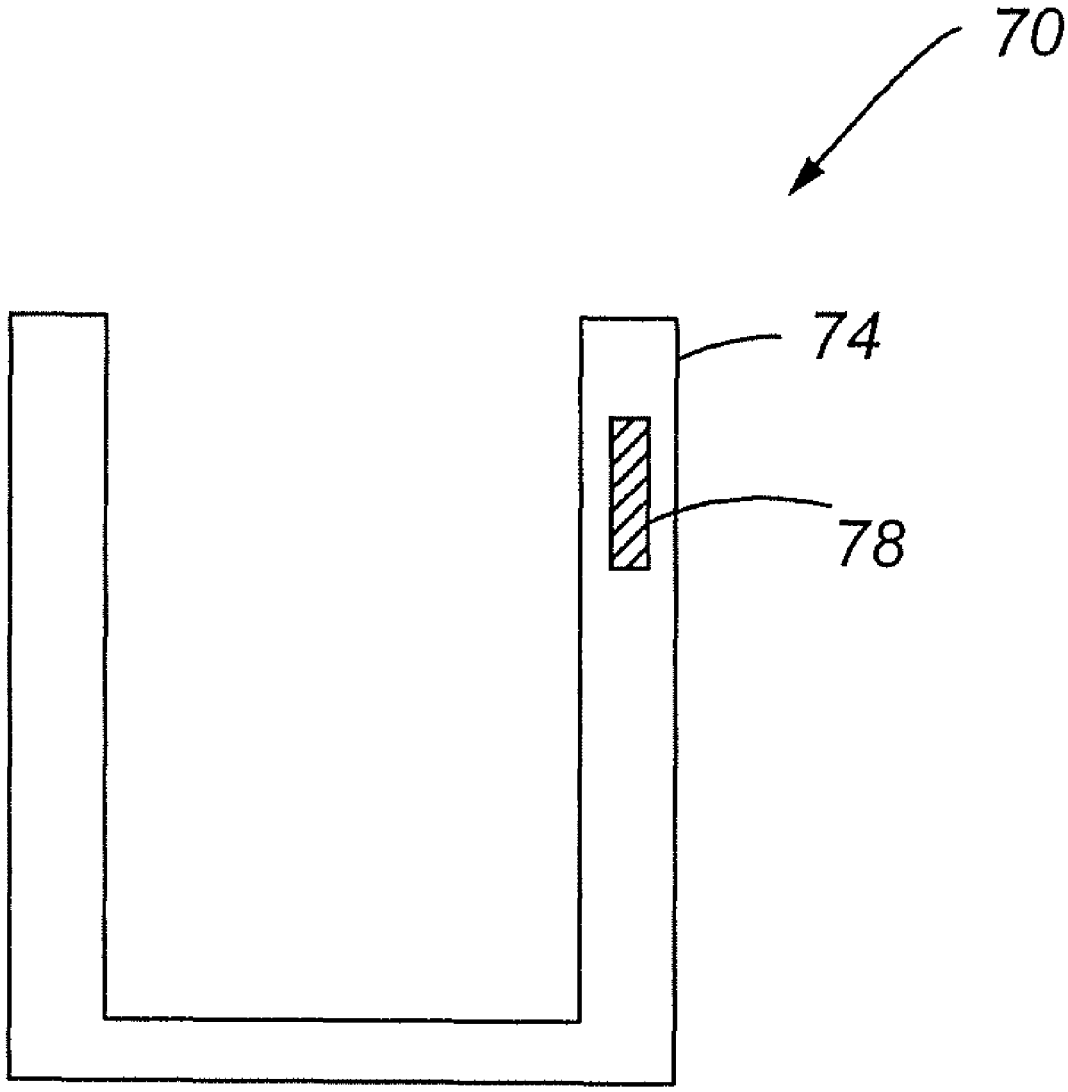
FIG. 10 is a cross-sectional illustration of a beverage container holder having an embedded magnet according to one embodiment of the present invention.

FIG. 10 is a cross-sectional illustration of a beverage container holder 70 of another embodiment of the present invention. The beverage container holder 70 includes an outer sleeve 74 which has an embedded magnet 78. In this embodiment, the sleeve 74 of the beverage container holder 70 includes (foamed resin) insulation which helps keep the beverage in the container either hot or cold. The magnet 78 is embedded within this insulation, resulting in a sleeve 74 for the beverage container holder 70 which is relatively smooth. The magnet may be embedded in the insulation by positioning the magnet in the mold during resin injection.

Figure 11:
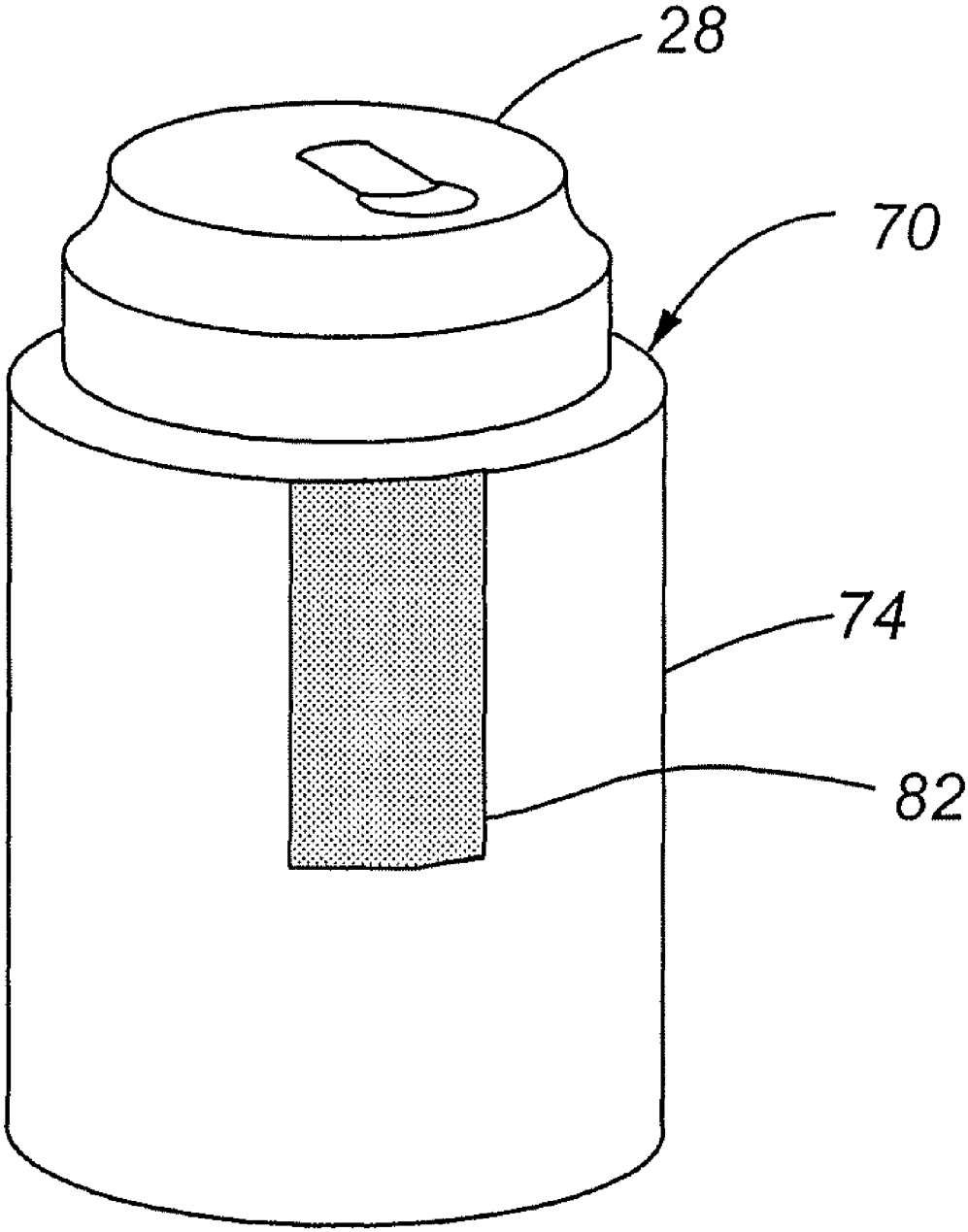
FIG. 11 is a perspective illustration of a beverage container holder having an embedded magnet and a visual and textured magnet location indicator according to an embodiment of the present invention.

FIG. 11 is a perspective illustration of a beverage container holder 70, and a beverage can 28, of this embodiment. The sleeve 74 of the beverage container holder 70 may also include a marking 82 or other visual indication of where the magnet 78 is located, allowing a user to quickly recognize which side of the beverage container holder 70 should be placed against the mounting surface in order to mount the beverage container holder 70. In another embodiment, the sleeve 74 of the beverage container holder 70 includes different surface texturing instead of, or in addition to a visual indication. The surface texturing may be imparted to the surface of the insulation during RIM by sandblasting or otherwise roughening a matching surface of the mold. This allows for a user to feel which portion of the beverage container holder 70 should be placed against the ferrous material. Additionally, the surface texturing may include a material which has a relatively high friction, such as a rubberized polymer, which helps prevent the beverage container holder 70 from sliding when placed against the mounting surface.

Figure 12:
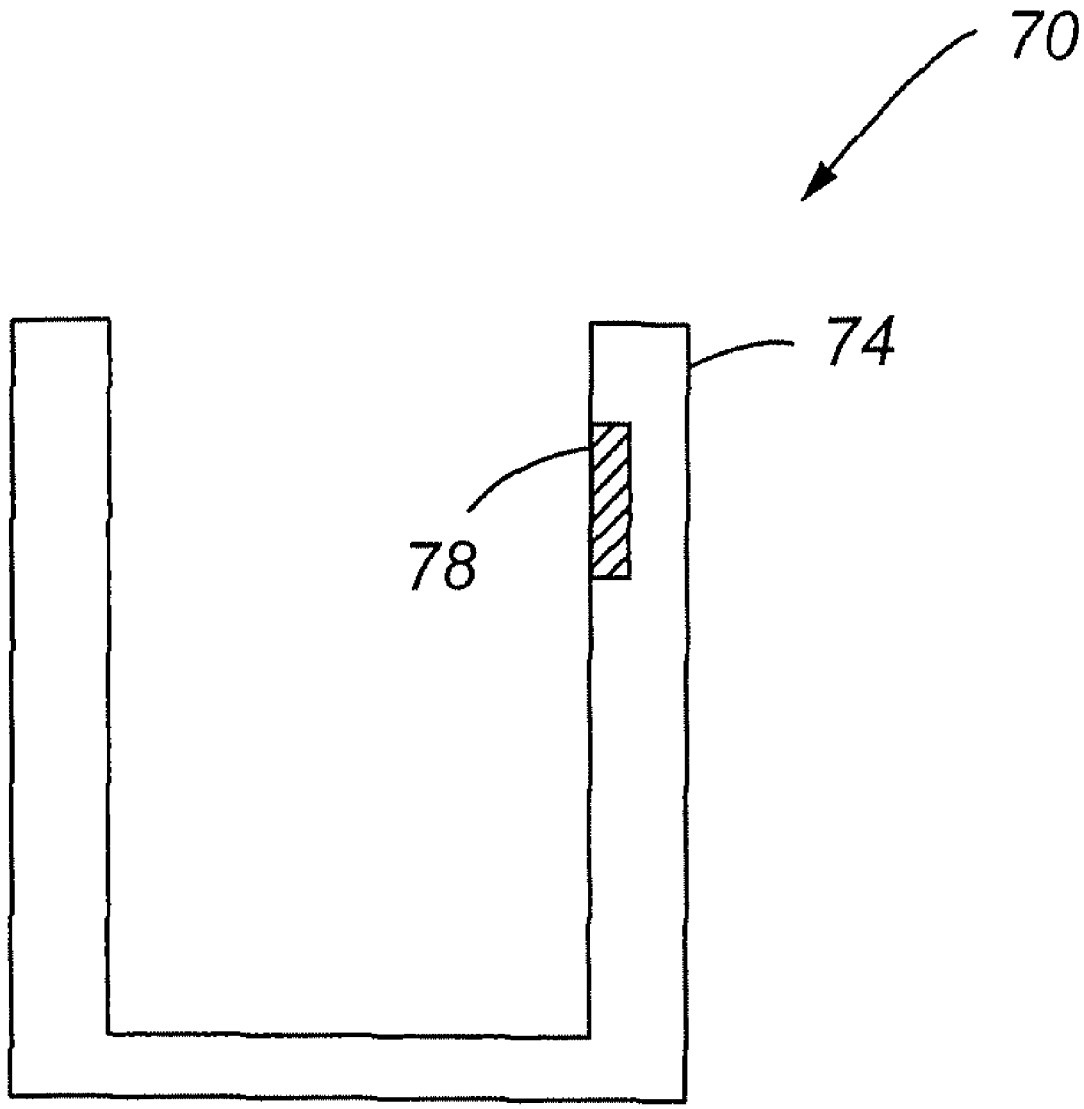
FIG. 12 is a cross-sectional illustration of a beverage container holder having an embedded magnet according to one embodiment of the present invention.

FIG. 12 illustrates another embodiment, in which the magnet 78 is located adjacent to the inside surface of the sleeve 74. Such a configuration may result in reduced manufacturing costs. Furthermore, if the beverage container holder 70 is made of rigid material, an aperture for receiving the magnet 78 may be molded into the inside surface of the sleeve 74, which may then receive the magnet 78 and secure it with adhesive or frictional forces.

Figure 13:
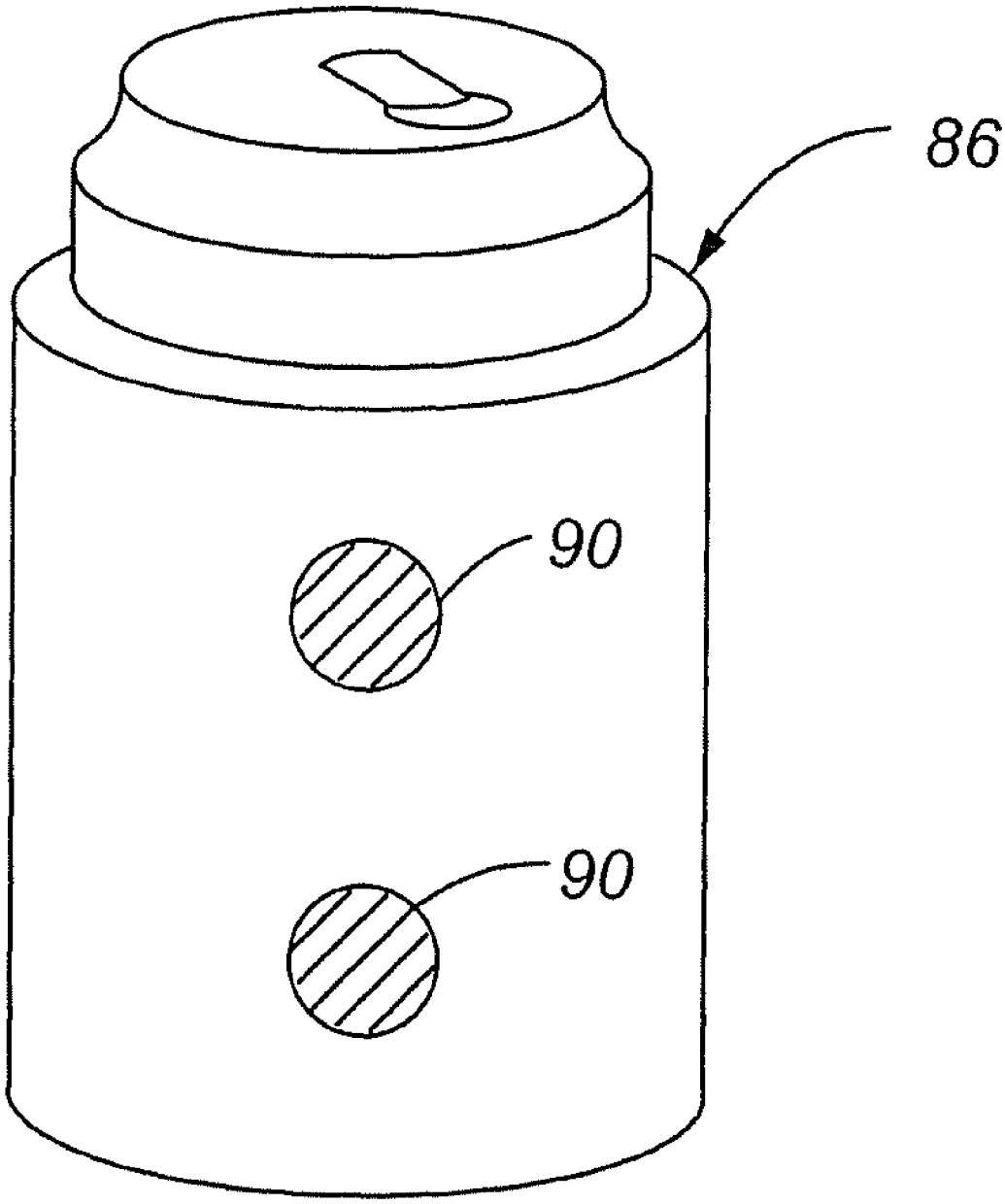
FIG. 13 is a perspective illustration of a beverage container holder having multiple magnets for an embodiment of the present invention.

The magnet within the beverage container holder has numerous alternative configurations. For example, as illustrated in FIG. 13, a beverage container holder 86 may have first and second magnets 90, in a vertical orientation with respect to one another. This vertical orientation of the magnets 90 help ensure the beverage container holder 86 does not rotate around a single magnet.

Figure 14:
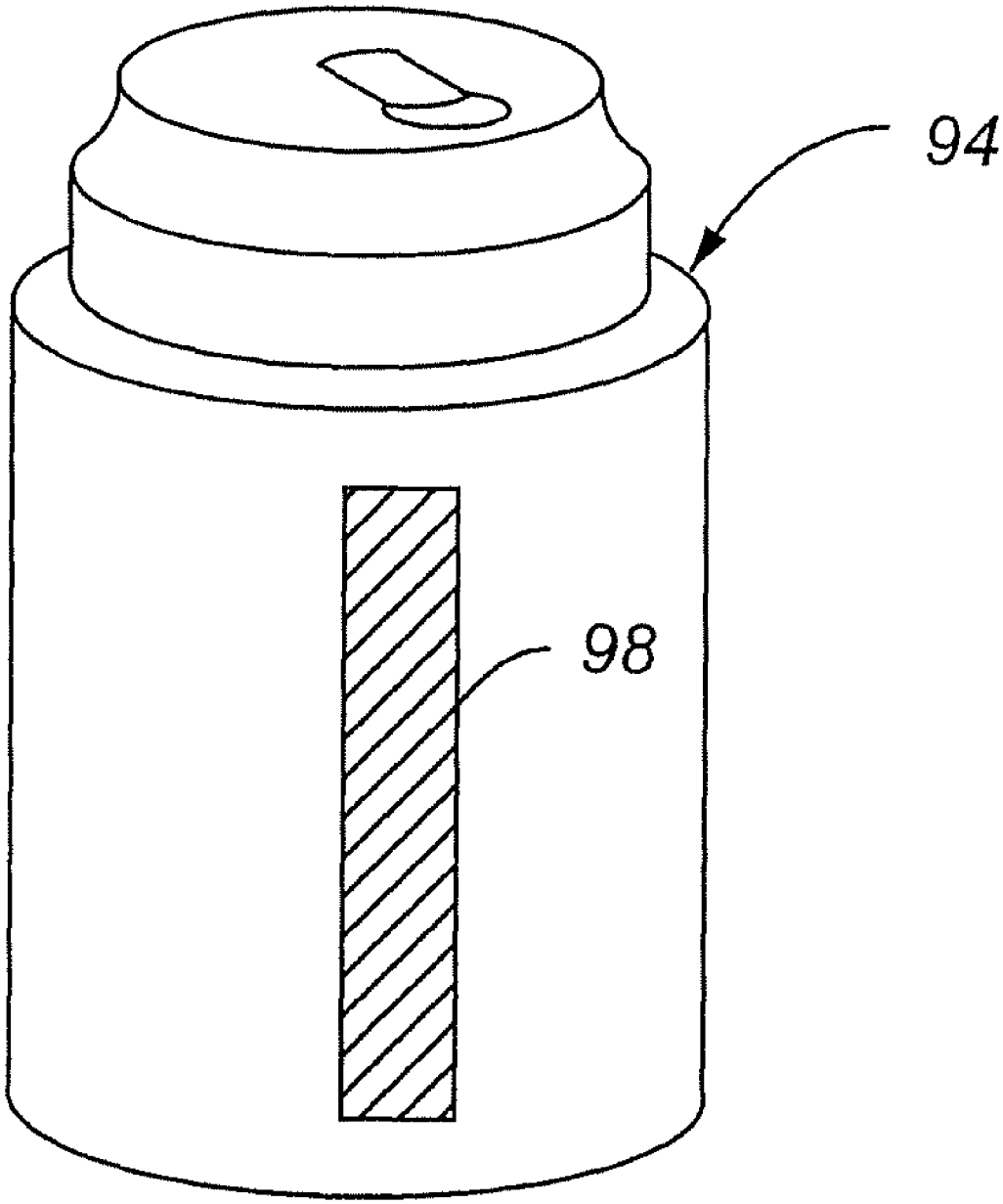
FIG. 14 is a perspective illustration of a beverage container holder having a magnetic strip according to an embodiment of the present invention.

In another embodiment, illustrated in FIG. 14, a beverage container holder 94 includes a magnet 98 which is configured as a vertical strip from the top to the bottom of the beverage container holder 94.

Figure 15:
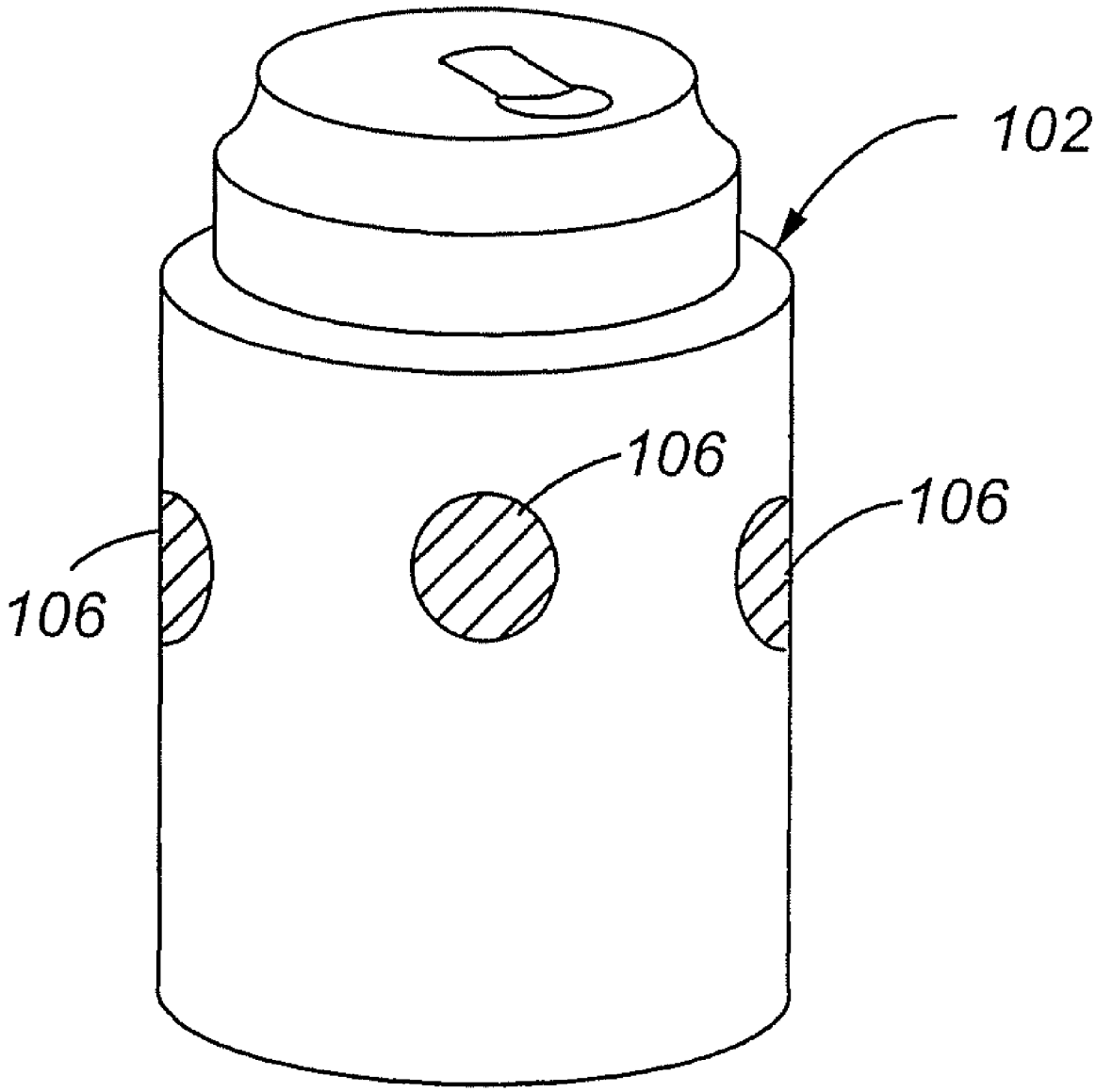
FIG. 15 is a perspective illustration of a beverage container holder having multiple magnets for one embodiment of the present invention.

In still a further embodiment, illustrated in FIG. 15, a beverage container holder 102 includes multiple magnets 106 located regularly or irregularly around the periphery of the beverage container holder 102. This configuration allows the beverage container holder 102 to be mounted in more than one orientation relative to the mounting surface.

Figure 16:
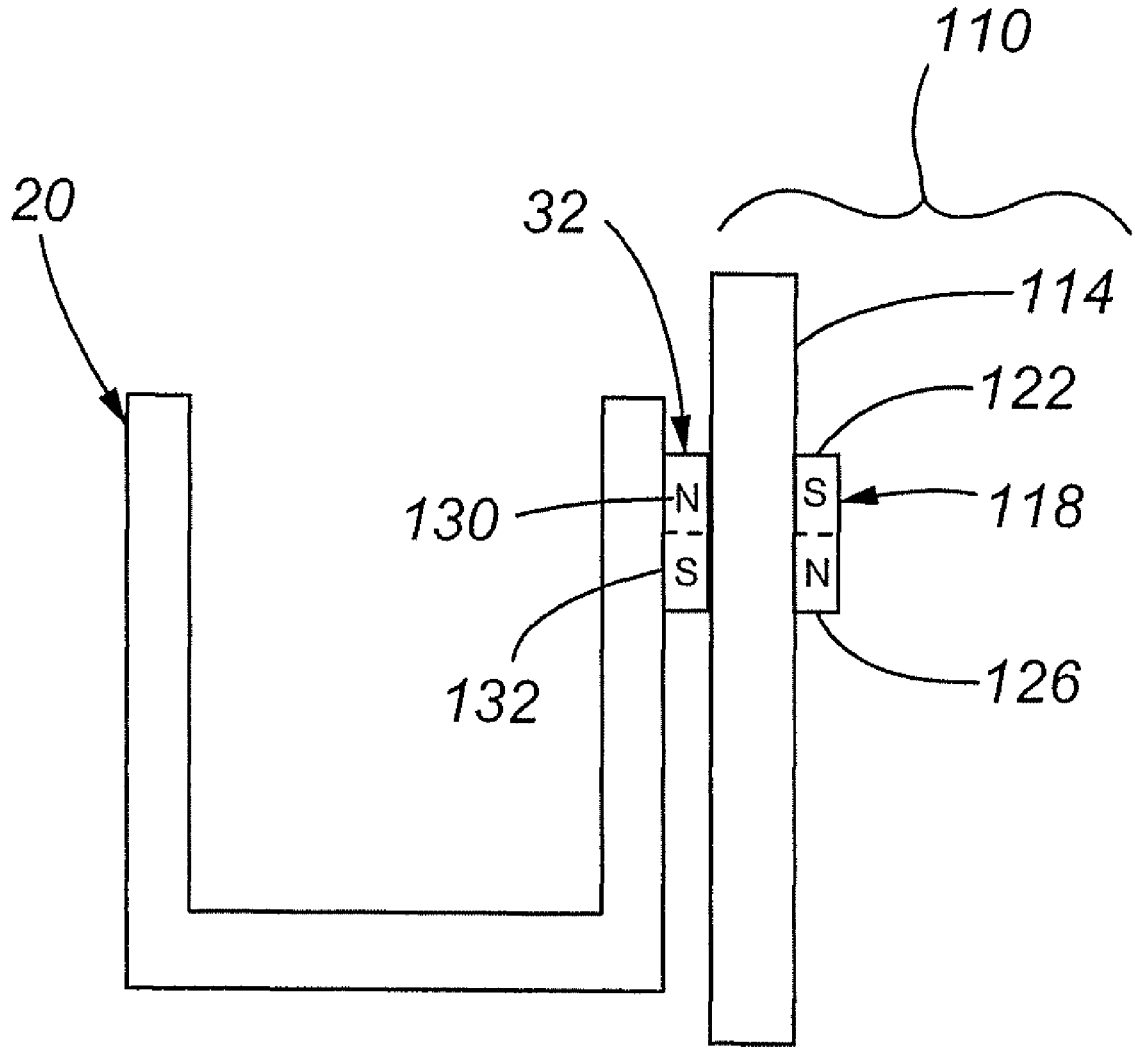
FIG. 16 is a cross-sectional illustration of a beverage container holder mounted to a mounting surface in which the mounting surface and beverage container holder include a bar magnet.

In yet another embodiment, illustrated in FIG. 16, a first polarized magnetic material, or first magnet 32, is positioned at the side of the holder while a second polarized magnetic material, or second magnet 118, is positioned on an opposing side of the mounting surface 110. In this embodiment, the mounting surface includes a diamagnetic or superdiamagnetic (or nonmagnetic and typically non-ferrous) material 114, and the second magnet 118 located on a side of the non-ferrous material 114, which is opposite the surface which will contact the beverage container holder 20. The second magnet 118 is a bar type magnet having a south (or first) pole 122 and a north (or second) pole 126 aligned in an vertical orientation. The first magnet 32 of the beverage container holder 20 is also a bar type magnet having a north (or second) pole 130 and a south (or first) pole 132, arranged in a vertical orientation. In this embodiment, the north pole 130 and the south pole 132 of the magnet 32 are aligned in an opposite vertical orientation as the north pole 126 and south pole 122 of the second magnet 118. Accordingly, the first and second magnets 32, 118 are attracted to each other which works to secure the beverage container holder 20 to the mounting surface 110.

Having a second magnet 118 associated with the mounting surface allows for a stronger interaction with the magnet 32 and the mounting surface 110 than would be present if the mounting surface simply has a ferrous material. Thus, in this embodiment, the non-ferrous material 114 may be relatively thick, and/or the magnet 32 may not be required to be as strong as compared to the strength of a magnet required to secure the beverage container holder 20 to a mounting surface not having a second magnet.

Another embodiment, illustrated in FIG. 17, the holder 20 includes the first magnet or polarized magnetic material 32 and the (dimagnetic) mounting surface 136 includes to a second magnet or polarized magnetic material 140, associated with a non-ferrous surface 144. The second magnet 140 is a disk type magnet including a south pole 148, and a north pole 152 on opposite sides of the disk. The beverage container holder 20 includes the first magnet 32, having a north pole 156 and a south pole 160 located on opposite sides of a disk magnet. In this embodiment, the second magnet 140 is attached to the non-ferrous material 144 of the mounting surface 136 such that the south pole 148 is oriented toward the surface which will contact the beverage container holder 20. The magnet 32 is attached to the beverage container holder 20 such that the north pole 156 is closest to the mounting surface 136. Accordingly, the magnets 32, 140, are attracted to each other and secure the beverage container holder to the mounting surface 136. Similarly as described above, having the second magnet 140 may allow for a thicker non-ferrous material 144, and/or allow for a magnet 32 associated with the beverage container holder 20 which is not required to be as strong, relative to what would be required if there were no second magnet 140 associated with the mounting surface.

It will be understood that the invention includes further embodiments which may have magnets associated with the mounting surface, such as, for example, a mounting surface having multiple magnets associated therewith such that the beverage container holder may be mounted in various positions. Furthermore, the magnet associated with the mounting surface may be embedded within the non-ferrous material, or may be located on the side of the mounting surface which contacts the beverage container holder. Furthermore, magnets associated with the mounting surface may be configured to align with the magnets of the beverage container holders described with reference to FIGS. 13-15.

FIGS. 8-9 depict multiple or elongated second magnetic materials 62 and 66 positioned along a length of a diamagnetic or superdiamagnetic mounting surface 52 to permit one or more magnetized beverage holders to be positioned along the reverse side of the mounting surface 52. Suitable markings can be provided on the visible reverse side of the mounting surface to permit ready identification of the magnetized location upon which the holder may be positioned.

Figure 18:
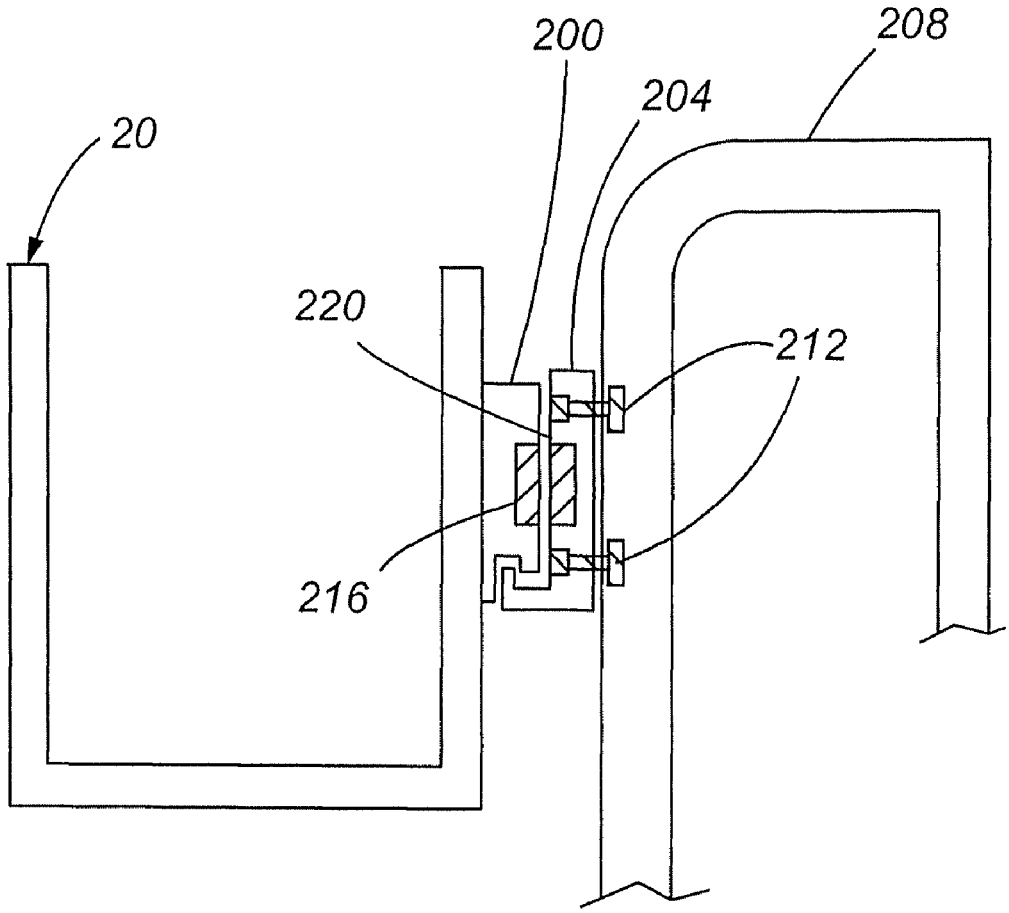
FIG. 18 is a cross-sectional illustration of a beverage container holder mounted to a mounting surface in which the mounting surface and beverage container holder include interlocking clips.
Figure 19:
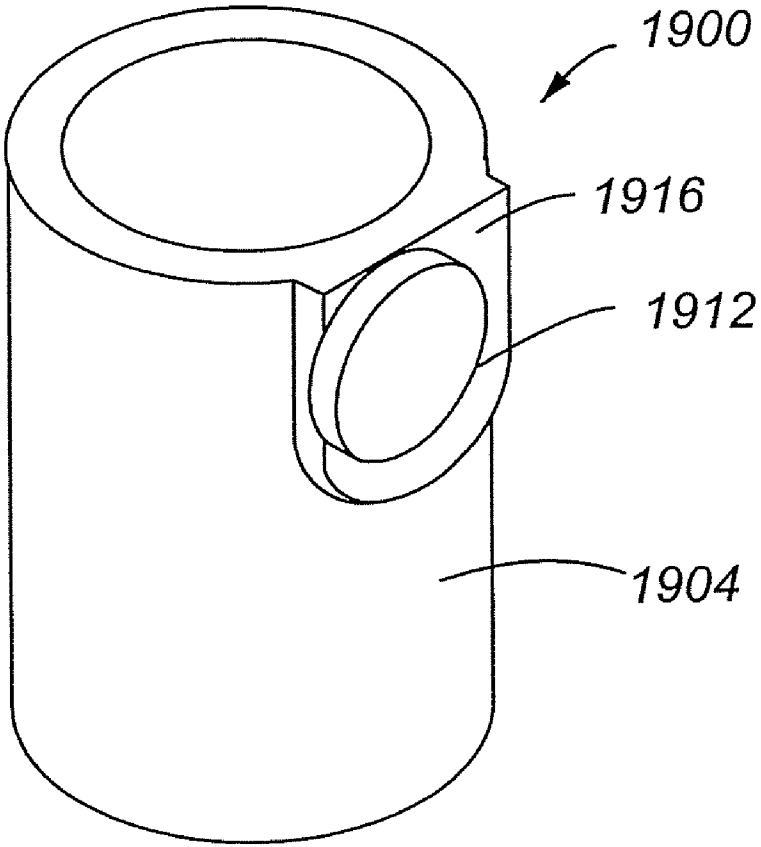
FIG. 19 is an isometric view of a beverage container holder according to another embodiment of the present invention.
Figure 20:
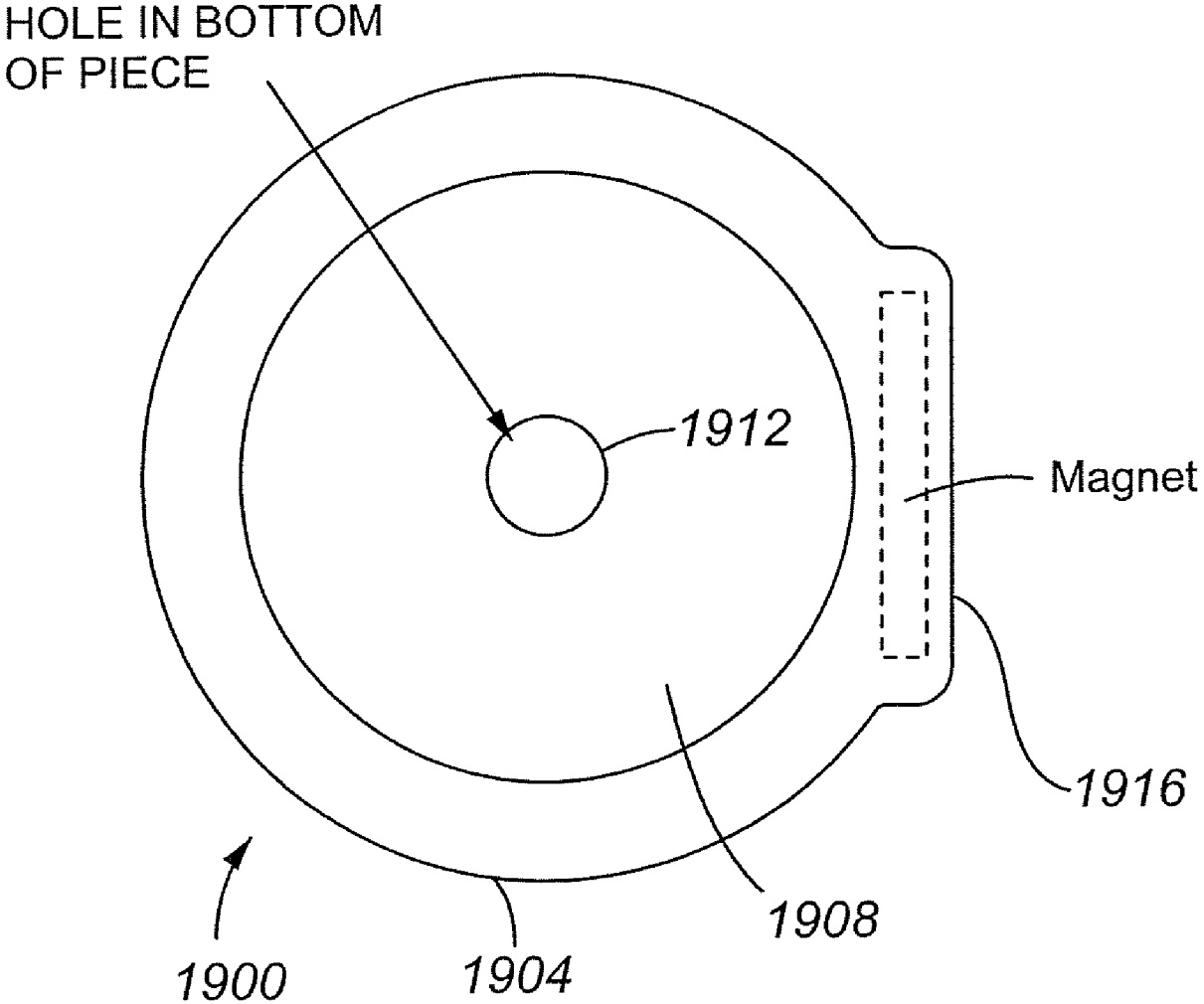
FIG. 20 is a top view of the beverage container of FIG. 19.
Figure 21:
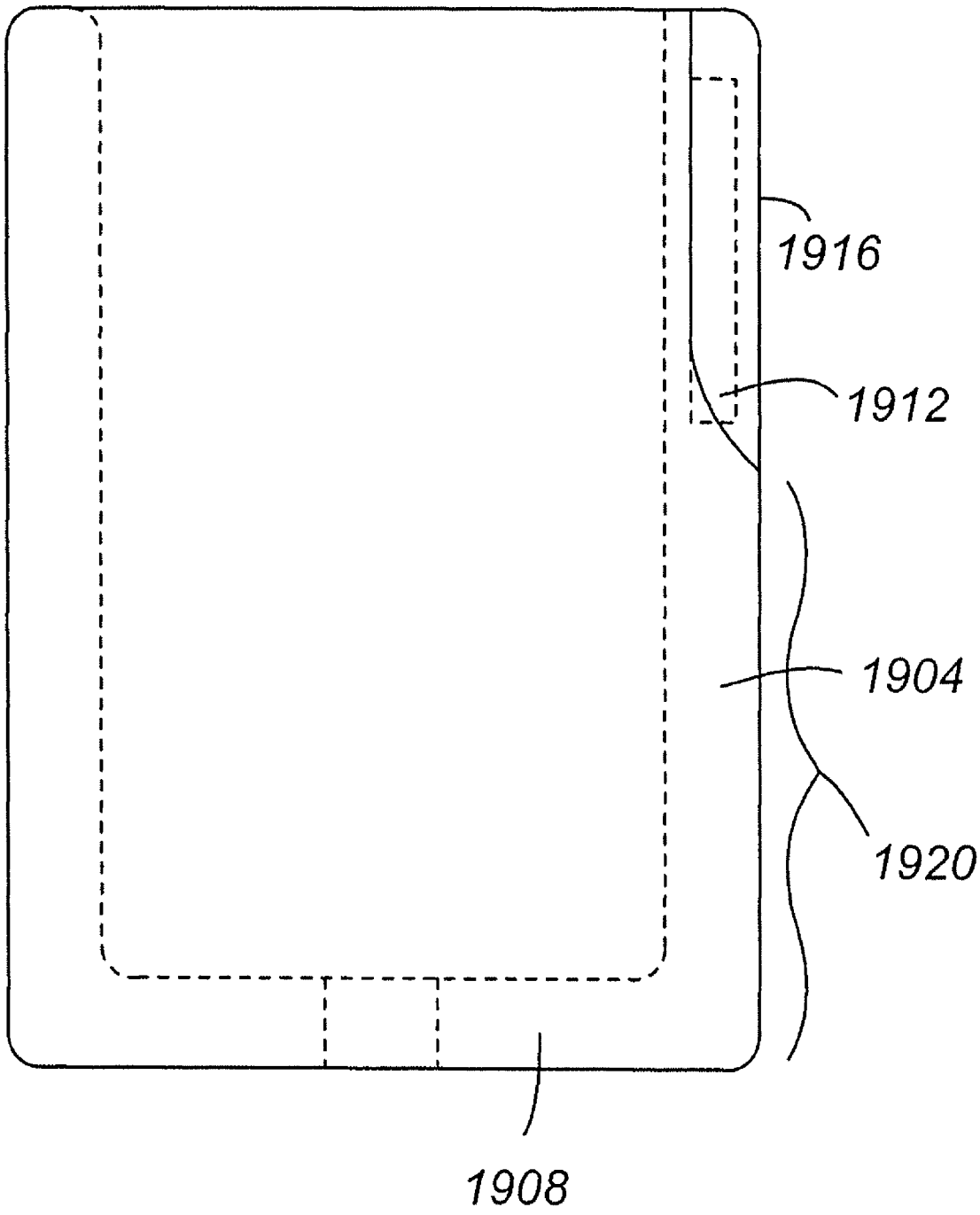
FIG. 21 is a side view of the beverage container of FIG. 19.
Figure 22:
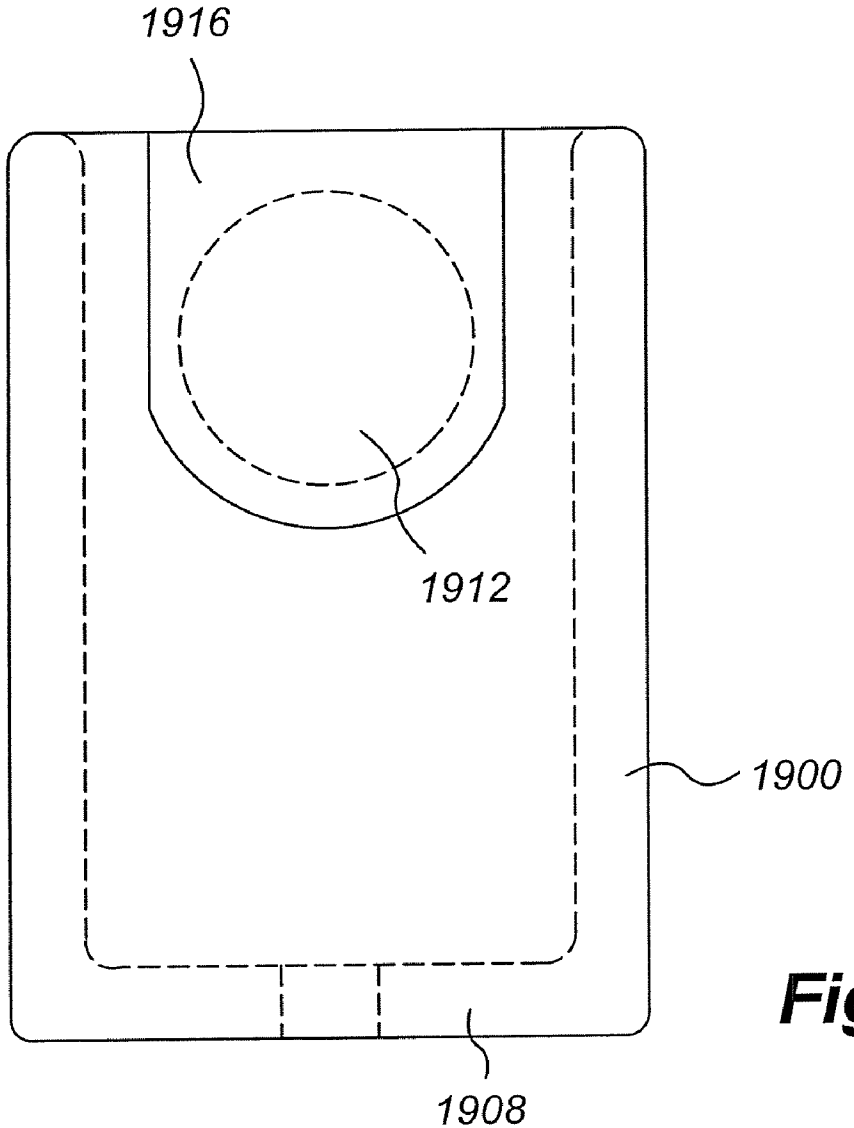
FIG. 22 is another side view of the beverage container of FIG. 19.

In another embodiment, illustrated in FIG. 18, the beverage container holder 20 includes a clip attachment 200. The clip attachment 200 is adapted to engage with a clip 204, which is attached to a non-ferrous surface 208. The opposing faces of the clips 200 and 204 are planar. In this embodiment, rivets 212 are used to secure the clip 204 to the non-ferrous surface 208. The clip attachment 200 includes a second magnet 216, which is oriented to be attracted to the first magnet 220 located in the clip 204. In this embodiment, the beverage container holder 20, and associated beverage container, are held in position in the clip 204 quite securely.

FIGS. 19-23 depict a magnetized beverage holder according to yet another embodiment. The holder 1900 includes a sleeve 1904 and base 1908. The magnet 1912 is embedded in the sleeve 1904. The disc-shaped magnet 1912 has opposing planar faces, which require the sleeve 1904 to have a planar face 1916 protruding from the otherwise cylindrically shaped sleeve 1904. As can be seen from FIG. 21, the face 1916 is coplanar with a lower portion 1920 of the cylindrically shaped sleeve 1904. When mounted to the mounting surface (not shown), the mounting surface contacts not only the planar face 1916 but also the lower portion 1920. This configuration provides a stable triangular-shaped contact surface having multiple points of contact. These multiple points of contact along at least most of the height of the holder 1900 provides a stable contact between the holder and the mounting surface. Unlike the holder design of FIG. 5 in which the magnet protrudes from the holder 24 and provides a fulcrum at the lower edge of the magnet, the planar holder contact area of the holder 1900 does not provide a fulcrum about which the holder can rotate in response to gravitational forces exerted on the holder and beverage container. Such rotation can destabilize substantially the ability of the holder to maintain a fixed, desired position on the mounting surface.

Figure 23:
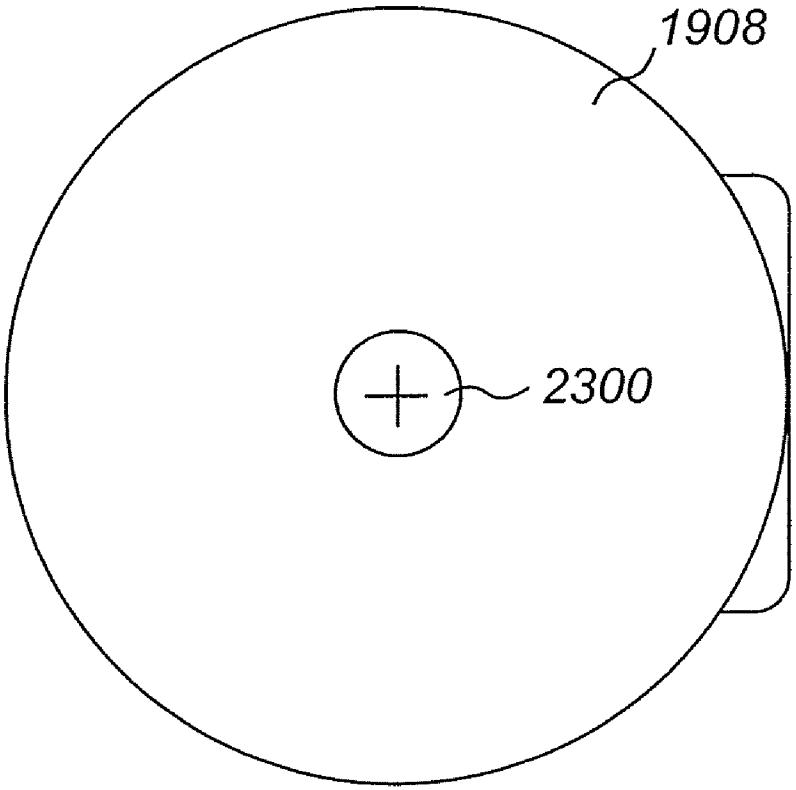
FIG. 23 is a bottom view of the beverage container of FIG. 19.

FIG. 23 further shows that the base 1908 of the holder 1900 includes at least one air passage 2300 to facilitate insertion and removal of the beverage container from the holder 1900. The passage 2300 provides an escape for air when the container is inserted into the holder 1900 and an entry for air when the container is removed from the holder 1900. In the absence of such a passage, the user would need to force the beverage container into the holder with sufficient force to cause air to be expelled at the flexible interface between the holder and container, and forcibly remove the container from the holder with sufficient force to overcome any suction, or negative pressure, caused by void space creation between the container base and holder base.

Figure 24A:
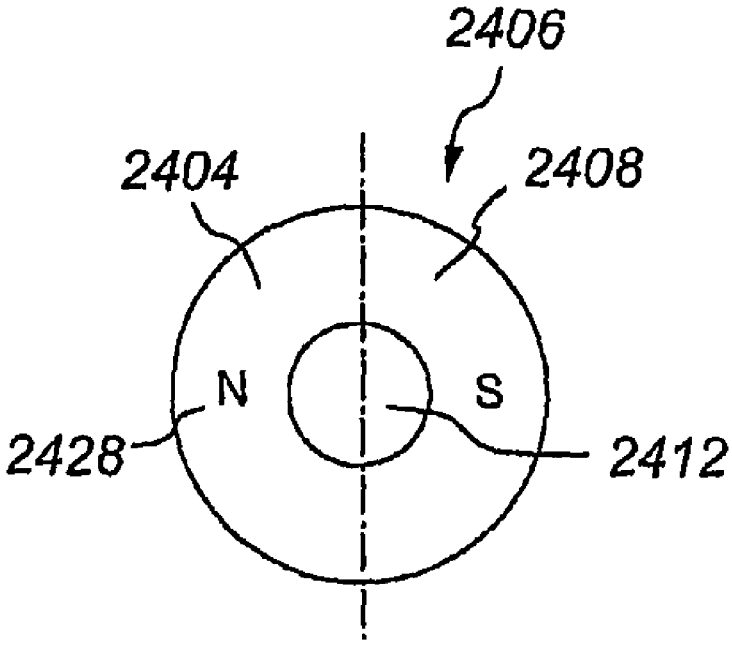
FIGS. 24A and B are, respectively, plan and side views of a magnet according to an embodiment of the present invention.
Figure 24B:
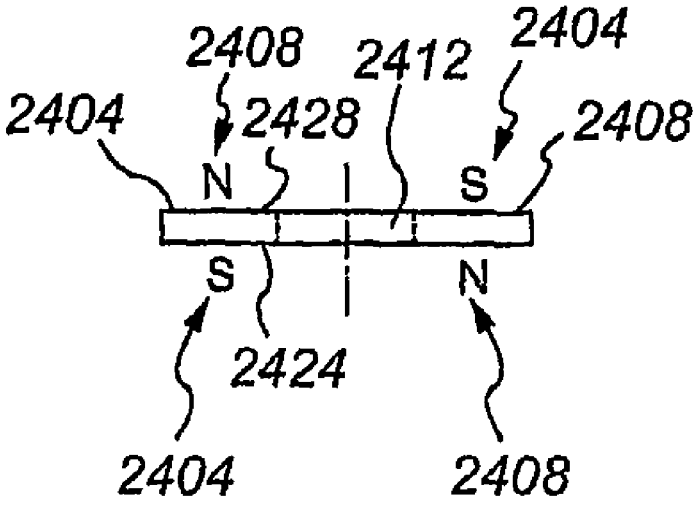

FIGS. 24A and 24B depict an embodiment of a magnet according to an embodiment. The magnet 2400 includes first and second polarized magnetic materials 2404 and 2408, which are integral with one another (though the materials 2404 and 2408 may be in the form of separate magnets optionally connected together). In one configuration, the materials are part of a common magnetic disc and created when the disc is magnetized. A hole 2412 is positioned at the center of the disc to reduce the amount of magnetic material needed for the magnet. At the location of the hole 2412, the first and second polarized magnetic materials are separated by a nonmagnetic material (e.g., air). As can be seen from FIG. 24B, the first and second polarized materials 2404 and 2408 have opposing polar orientations. In other words, the first material 2404 has first and second poles 2416 and 2420 positioned at first and second surfaces 2424 and 2428, respectively. The second material 2408 has first and second poles 2416 and 2420 positioned at second and first surfaces 2428 and 2424, respectively. In other words, the magnet 2400 has more than two poles. Additional poles may be provided depending on the application.

The magnet is preferably a rare earth magnet from Neodymium Iron Boron N35H. As will be appreciated, Neodumium, in its unprocessed state, is a powder that is not magnetized. The powder is pressed into a mold under tons of pressure to compact the powder to form the shape of a magnet. The magnet is then magnetized in a machine that applies a very strong magnetic field, polarizing the magnet with at least one pole. As noted, in the preferred design multiple poles are formed on the opposing faces of the magnet by magnetizing a common disc of material.

Figure 25A:
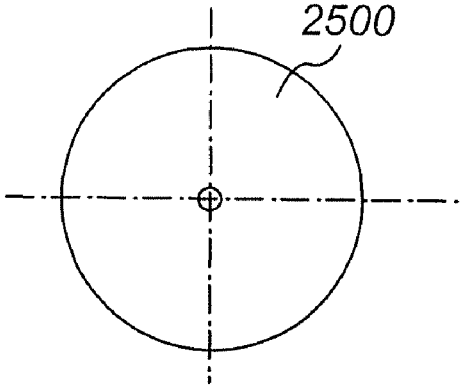
FIGS. 25A and B are, respectively, plan and side views of the back plate.

FIGS. 25A and B depict a base plate 2500 that is received on one of the first and second surfaces 2424 and 2428. The base plate 2500 is positioned on the surface of the magnet facing the interior of the holder or the beverage container. The base plate 2500 is preferably a paramagnetic or superparamagnetic material but can be a diamagnetic or superdiamagnetic material depending on the application.

Figure 26:
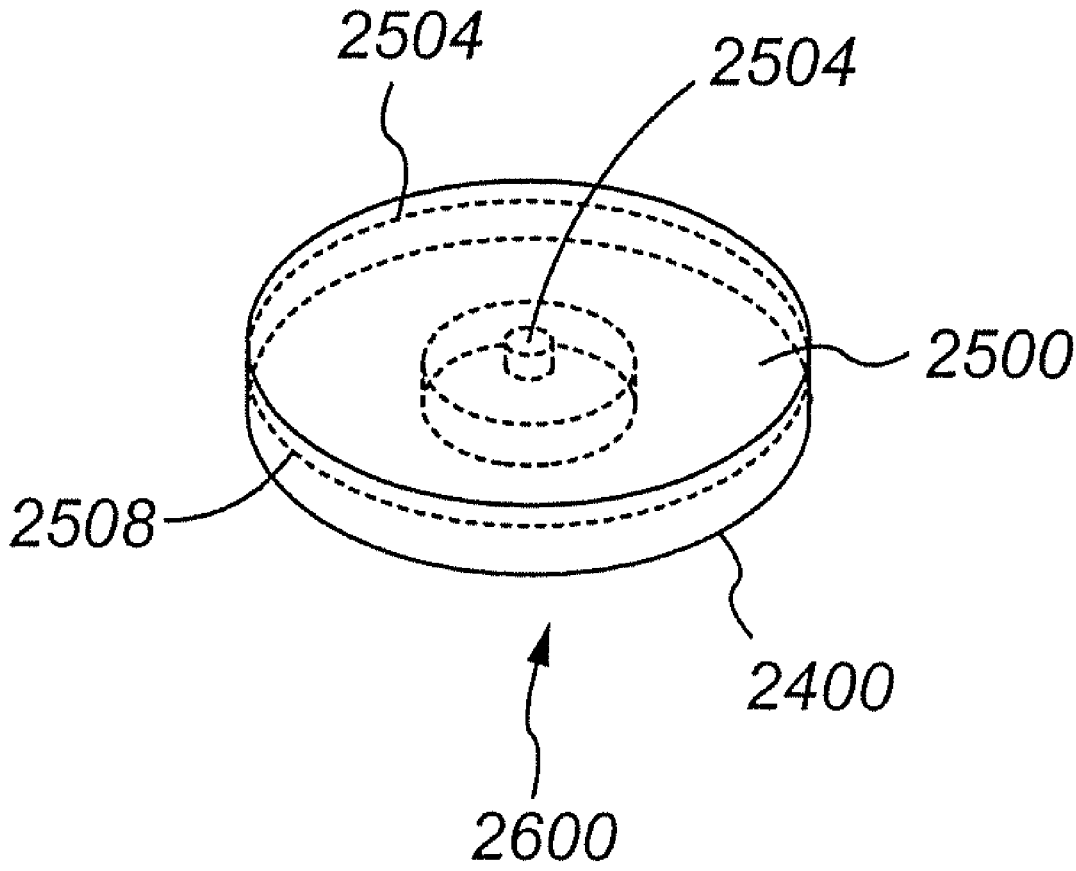
FIG. 26 is an isometric view showing a magnet assembly comprising the magnet and back plate.

FIG. 26 shows a magnet assembly 2600 including the magnet 2400 and base plate 2500. The base plate 2500 "short circuits" the flux on the reverse side of the magnet assembly 2600 and thus causes the magnetic flux lines to be altered. Flux lines pass through the base plate 2500 but are displaced into the plane of the base plate 2500 or towards the magnet-containing side of the plate 2500. This causes the flux lines to project further outward on the side of the magnet opposing the base plate. Preferably, most of the flux lines pass through the mounting surface. In other words, the magnetic force adjacent to the first (or reverse) surface 2504 of the plate 2500 is less than that adjacent to the second surface 2508. This effectively decreases any magnetic force applied to beverage containers having magnetic properties while increasing the magnetic force of attraction with the mounting surface.

The process to manufacture the holder 1900 will now be discussed with reference to FIGS. 27, 28, and 29A-J.

Figure 27:
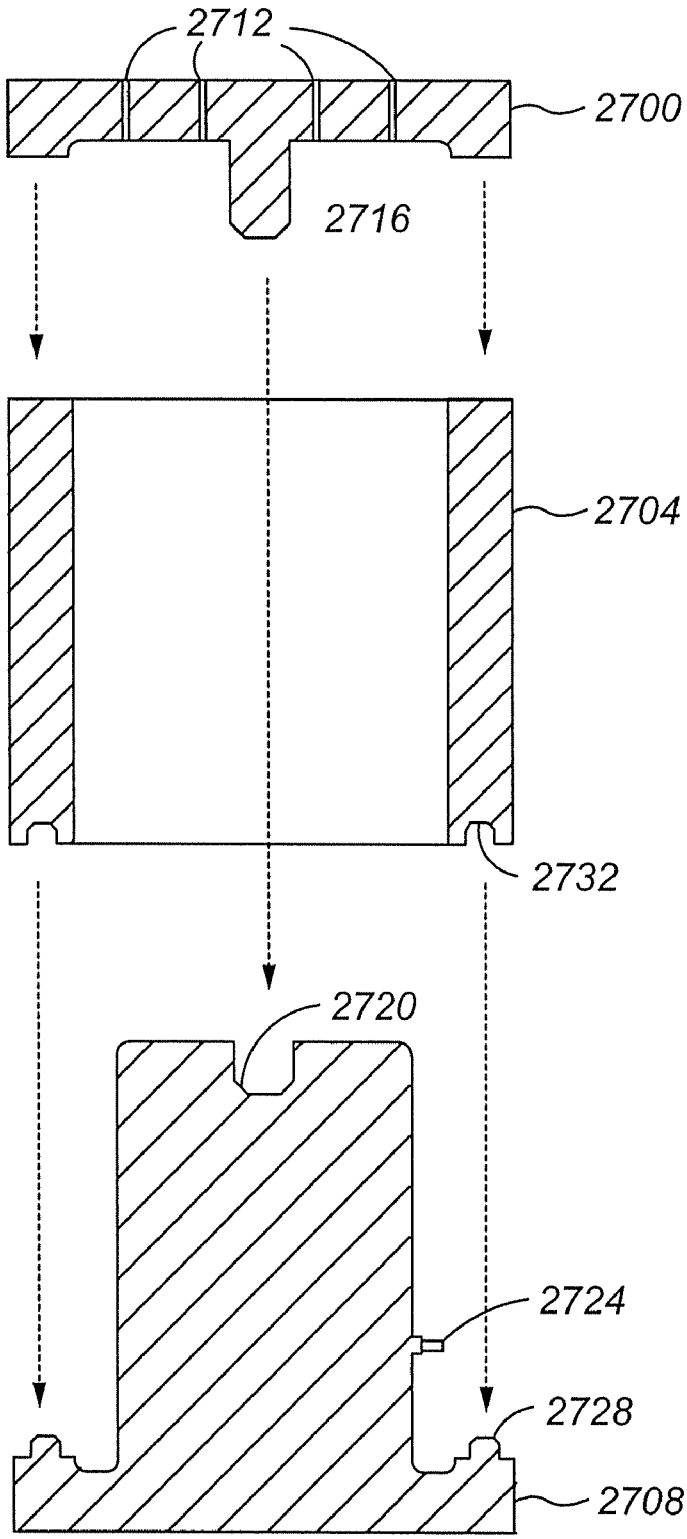
FIG. 27 is a disassembled view of a mold according to an embodiment of the present invention.
Figure 28:
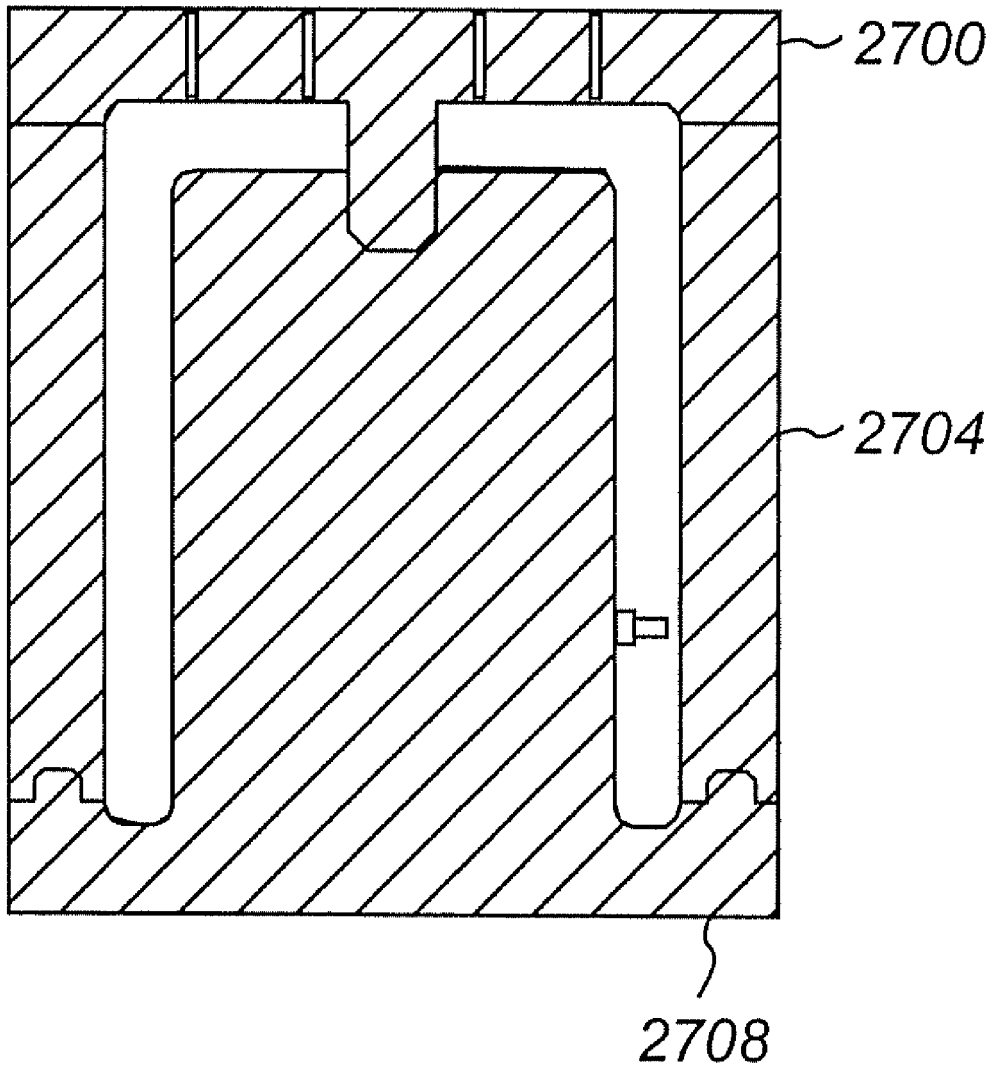
FIG. 28 is an assembled view of the mold of FIG. 27.

Referring to FIG. 27, the mold includes a cap mold 2700, side mold 2704, and base mold 2708. The cap mold 2700 engages the side mold 2704 and includes a plurality of vent holes 2712 for removal of air and excess resin and an alignment cap pin 2716 that engages, in a male/female relationship, a matching feature 2720 in the base mold. The base mold 2708 includes a paramagnetic or superparamagnetic protrusion 2724 emanating from a side surface of the base mold. The magnet assembly 2600 engages and is retained, through magnetic attraction, by the protrusion 2724 during resin injection. To avoid disorientation of the magnet assembly during resin injection, the force of attraction between the magnet assembly and the protrusion exceeds that between the magnet assembly and any other portion of the mold assembly and the lateral forces exerted on the magnet assembly by the resin during injection and curing. Preferably, the cap mold 2700, side mold 2704, and base mold 2708 are formed preferably from a diamagnetic or superdiamagnetic material, with aluminum being more preferred. To provide further alignment, the base mold 2708 includes a cylindrically shaped alignment ring 2728 which engages, in a male/female relationship, a cylindrically shaped groove 2732 in the side mold 2704.

The manufacturing process will now be described with reference to FIGS. 29A-J.

Figure 29A:
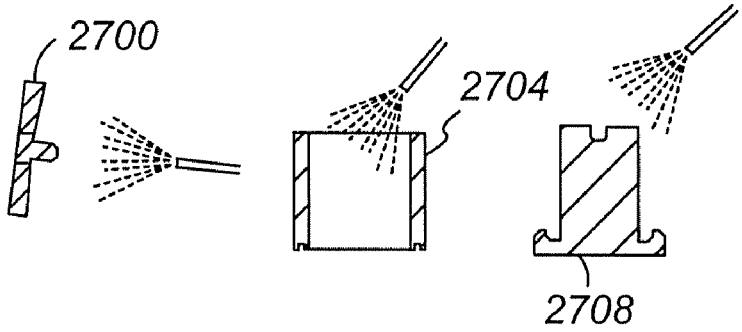
FIGS. 29A-J are a series of pictures depicting a process for manufacturing the beverage container of FIG. 19.

Referring to FIG. 29A, the interiors of the cap mold, side mold, and base mold are sprayed with a mold release agent. The mold release agent is either an oil-based or water-based formula that generally evaporates after the molding has been completed. Because the holder will be printed after molding, water-based mold release is preferred as it produces a better surface for ink adhesion.

Figure 29B:
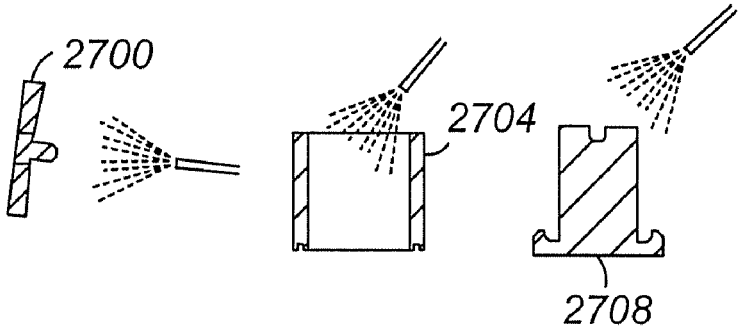

Referring to FIG. 29B, the interior surfaces of the cap mold, side mold, and base mold are sprayed with an outer color coating used to hide defects in the foam color mixing. The RIM process requires the mold to be sprayed with a mold release and color coating to hide the mixing color swirls of the two-part resin. This produces a uniform color product that is removed easily from the mold.

Figure 25B:
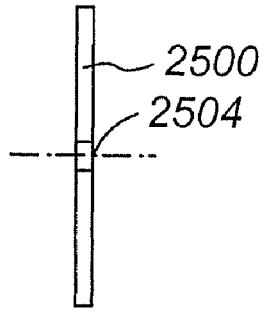
Figure 29C:
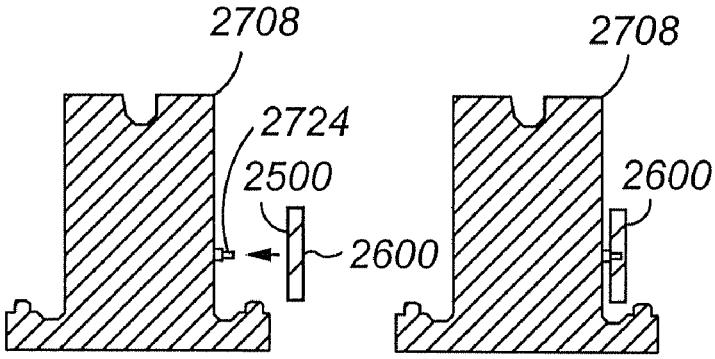

Referring to FIG. 29C, the magnet assembly 2600 is positioned magnetically on the protrusion 2724 (which is preferably steel). As can be seen from FIGS. 25A-B and 26, the backing plate 2500, which faces the base mold 2708, includes a central passage 2504 which receives the protrusion 2724. The hole 2412 in the magnet further receives the protrusion 2724. As noted, the magnet assembly 2600 is attracted magnetically to the steel in the protrusion 2724 and remains in a stationary, fixed position during resin injection and curing. As can be seen in FIG. 29C, the plane of the backing plate 2500 is parallel to and spaced apart from the adjacent surface of the base mold 2708. The protrusion includes a step to provide the proper stand off distance from the adjacent interior surfaces of the mold.

Figure 29D:
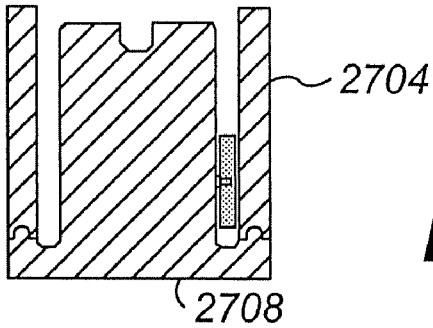

Referring to FIG. 29D, the side mold 2704 is inserted into the base mold 2708 and clamped into place.

Figure 29E:
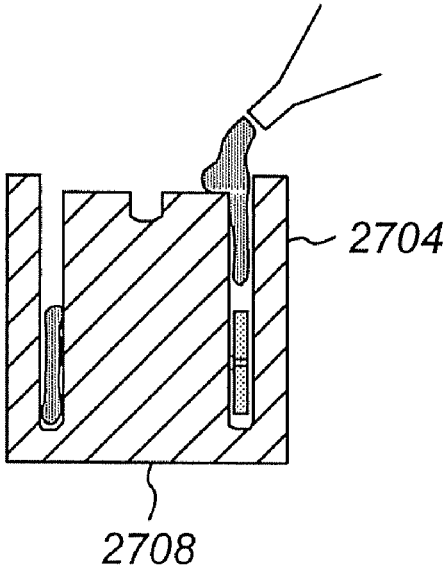

Referring to FIG. 29E, a two-part foam resin is introduced into the interior cavity defined by the base mold 2708 and side mold 2704. The cavity is filled to about ⅔ full, depending on the expansion properties of the resin. The density of the foam can vary depending on the foam type, heat and ambient weather conditions.

Figure 29F:
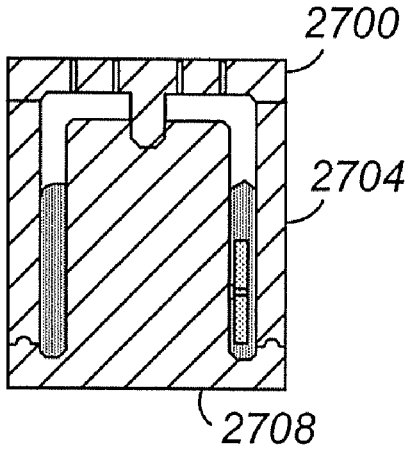

Referring to FIG. 29F, the cap mold 2700 is inserted onto the top of the side mold 2704 and clamped into place.

Figure 29G:
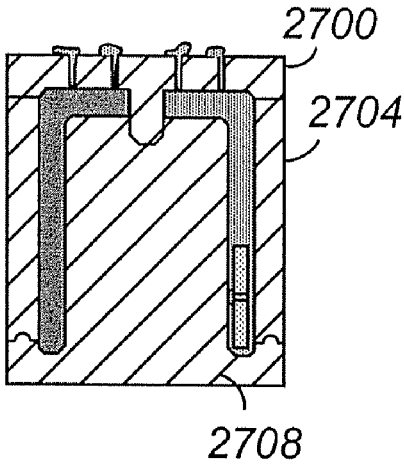

Referring to FIG. 29G, heat is applied to the mold assembly to accelerate the foam expansion and curing process. The foam expands and escapes out of the vent holes 2712 on the top of the cap mold 2700.

Figure 29H:
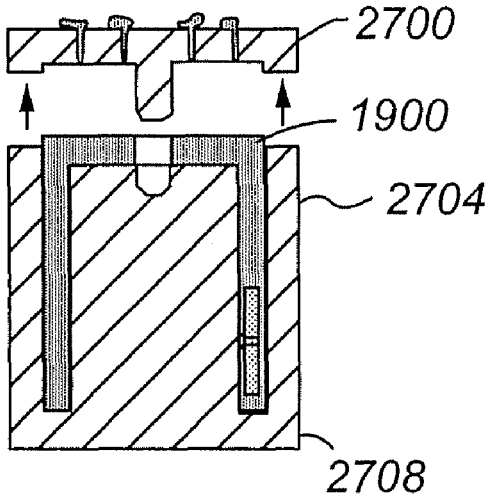

Referring to FIG. 29H, after the foam has cured (which typically requires from about 1 to about 15 minutes depending on mold temperature and resin formulation), the cap mold 2700 is removed.

Figure 29I:
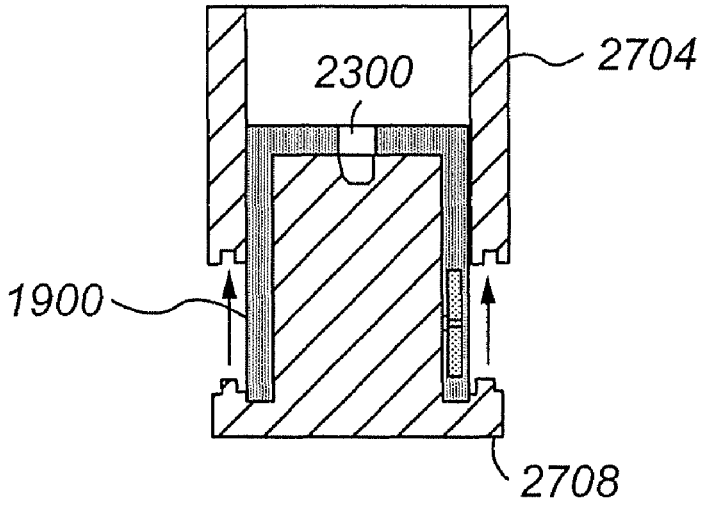

Referring to FIG. 29I, the side mold 2704 is removed.

Figure 29J:
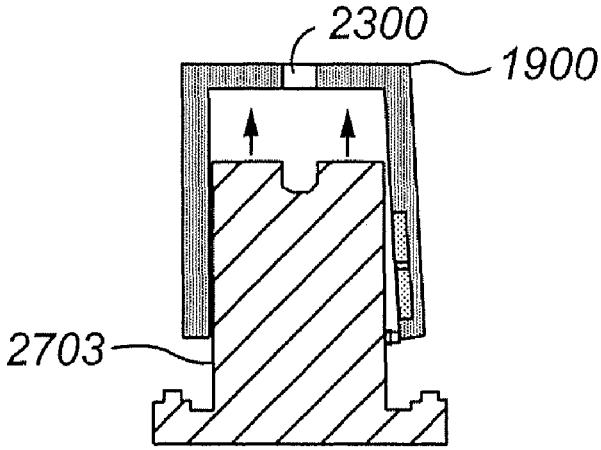

Finally, referring to FIG. 29J the beverage container holder 2900 is removed by stretching the sidewall containing the magnet over the protrusion. Since the insulation in the holder sidewall is flexible, it may be deformed readily for removal from the base mold after RIM is completed. As can be seen from the above figures, the magnet assembly is embedded fully in the sidewall of the holder with the exception of a small hole from the protrusion used to hold the magnet assembly in place during RIM.

The holder 2900 may then be printed with desired designs using multiple screen printing techniques. The magnet, during printing, is used as an index. The insulation material in the holder can withstand a brief exposure up to 350 degrees Fahrenheit for the application of thermal graphics.

Numerous alternatives also exist for the configuration of the beverage container holder. As mentioned above, the holder may be made of a flexible insulation material, or a rigid material. The beverage container holder may have different sizes, in order to accommodate beverage containers which are different sizes, such as different sized beverage cans, bottles, cups, or glasses, for example. As will be appreciated, the container holder is fixed in internal and external diameter along its height. It cannot be wrapped around the beverage container and adjusted to the approximate diameter of the container. Alternatively, the beverage container holder may be expandable or adjustable to receive different sized beverage containers. Furthermore, the beverage container holder may be large enough to completely cover the beverage container, having an aperture for a straw, or having a zipper or other closure device which may be opened in order to access the beverage within the beverage container. Although much of the description is directed to a multi-pole magnet, it is to be understood that a single-pole magnet may also be employed.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. The features of the embodiments of the invention may be combined in ways or designs other than those discussed above. It is intended to obtain rights which include alternative embodiments to the extent permitted, including other feature combinations, alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method for securing a beverage container to a mounting surface, comprising:

providing an insulated holder containing said beverage container, the holder having a sleeve portion, a base portion, and a magnet comprising first and second polarized magnetic materials positioned at the sleeve portion, the first and second polarized magnetic materials each have first and second poles, the first pole of the first polarized magnetic material being positioned opposite and adjacent to the second pole of the second magnetic material and the second pole of the first polarized magnetic material being positioned opposite and adjacent to the first pole of the second magnetic material; and placing said holder adjacent to and in contact with said mounting surface, wherein said first and second polarized magnetic materials maintain said holder and said beverage container in a desired position and orientation on said mounting surface, wherein said mounting surface is substantially vertical and engages the side of the holder containing the magnet, wherein a side of the beverage container is at least substantially parallel to the mounting surface when the holder is in contact with said mounting surface, wherein a layer of insulation material is positioned between the first polarized magnetic material and the mounting surface when the holder is in contact with said mounting surface, and wherein a magnetic force of attraction at an interface between the holder and the mounting surface is sufficient to overcome a gravitational force exerted on the beverage container and the holder, whereby said holder and said beverage container remain stationary at the desired position on the mounting surface.

2. The method of claim 1, wherein the first and second polarized magnetic materials are positioned only in an upper half of the holder, wherein at least a portion of an outer surface of the holder adjacent to the first polarized magnetic material is coplanar with an elongated portion of the lower half of the holder, the elongated portion of the holder extending substantially an entire height of the lower half of the holder.

3. The method of claim 1, wherein the sleeve portion has a height above the base portion, the holder having a fixed diameter along substantially the entire height and wherein the holder is cylindrically shaped.

4. The method of claim 1, wherein said magnetic force of attraction is at least about 1200 gauss and said magnet comprises neodymium.

5. The method of claim 1, wherein the sleeve portion of the holder is not wrappable about the container.

6. The method of claim 1, wherein said first polarized magnetic material is embedded within said holder such that a first layer of insulation material lies between the first polarized magnetic material and the mounting surface and a second layer of insulation material lies between the first polarized magnetic material and the beverage container.

7. The method of claim 1, wherein said magnetic force of attraction ranges from about 800 to 12,300 gauss.

8. The method of claim 1, wherein said mounting surface is a non-ferrous material with a ferrous material located adjacent thereto and wherein the non-ferrous material is positioned between the first polarized magnetic material and the ferrous material.

9. The method of claim 1, wherein the first and second polarized magnetic materials are spaced apart from one another and separated by a nonmagnetic material.

10. The method of claim 1, wherein said holder includes surface texturing on an outside surface of the holder adjacent to the first polarized magnetic material and wherein the surface texturing is in the insulation material.

11. The method of claim 1, wherein an exterior portion of the holder is adjacent to and covers a face of the first polarized magnetic material and wherein at least most of the exterior portion of the holder is planar to engage the mounting surface.

12. The method of claim 1, wherein said first and second polarized magnetic materials are located in an upper half and not a lower half of said holder and wherein a backing material separates the first and second polarized materials from the insulation material.

* * * * *